US005610005A

United States Patent [19]

Kawakami et al.

[11] Patent Number: 5,610,005

[45] Date of Patent: Mar. 11, 1997

[54] SILVER HALIDE COLOR PHOTOGRAPHIC LIGHT-SENSITIVE MATERIAL

[75] Inventors: Hiroshi Kawakami; Junji Nishigaki, both of Ashigara, Japan

[73] Assignee: Fuji Photo Film Co., Ltd., Kanagawa, Japan

[21] Appl. No.: 662,290

[22] Filed: Jun. 12, 1996

Related U.S. Application Data

[63] Continuation of Ser. No. 346,928, Nov. 23, 1994, abandoned.

[30] Foreign Application Priority Data

Nov. 25, 1993 [JP] Japan ..... 5-317483

[51] Int. Cl.[6] ..... G03C 1/16; G03C 1/09; G03C 1/08

[52] U.S. Cl. ..... 430/574; 430/576; 430/583; 430/594; 430/595; 430/599; 430/603; 430/611

[58] Field of Search ..... 430/583, 595, 430/599, 574, 576, 577, 603, 611, 594

[56] References Cited

U.S. PATENT DOCUMENTS

| | | | |
|---|---|---|---|
| 2,052,754 | 9/1936 | Dieterle et al. | 430/583 |
| 3,717,468 | 2/1973 | Sakazume et al. | 430/599 |
| 3,718,475 | 2/1973 | Shiba et al. | 430/583 |
| 3,729,319 | 4/1973 | Jefferson et al. | 430/583 |
| 3,745,014 | 7/1973 | Nakazawa et al. | 430/583 |
| 3,765,899 | 10/1973 | Sato et al. | 430/583 |
| 4,960,689 | 10/1990 | Nishikawa et al. | 430/551 |
| 5,079,138 | 1/1992 | Takada | 430/599 |
| 5,190,855 | 3/1993 | Toya et al. | 430/597 |
| 5,389,505 | 2/1995 | Nishigaki | 430/583 |
| 5,538,836 | 7/1996 | Ueda et al. | 430/583 |
| 5,538,838 | 7/1996 | Suga et al. | 430/583 |

FOREIGN PATENT DOCUMENTS

| | | | |
|---|---|---|---|
| 1238785 | 7/1971 | United Kingdom | 430/583 |
| 1325993 | 1/1972 | United Kingdom | 430/583 |

*Primary Examiner*—Lee C. Wright

*Attorney, Agent, or Firm*—Birch, Stewart, Kolasch & Birch, LLP

[57] ABSTRACT

A color photographic light-sensitive material which has a high storage stability and a high sensitivity and in which photographic properties vary little with the passage of time from photography to development is provided. At least one light-sensitive silver halide emulsion layer constituting a silver halide color photographic light-sensitive material is spectrally sensitized with at least one type of a spectral sensitizing dye represented by Formula (I) below, and at least one silver halide emulsion contained in this light-sensitive silver halide emulsion layer is subjected to reduction sensitization in the manufacturing process of the emulsion. (In Formula (I), each of $R_{11}$ and $R_{12}$ represents an alkyl group, $Z_{11}$ represents a group of atoms required to form a benzene ring, $Z_{12}$ represents a group of atoms required to form a benzothiazole nucleus, a benzoselenazole nucleus, a benzoxazole nucleus, or a naphthoxazole nucleus, and $X_{11}$ represents a charge-balancing counter anion.)

Formula (I)

20 Claims, No Drawings

SILVER HALIDE COLOR PHOTOGRAPHIC LIGHT-SENSITIVE MATERIAL

This application is a continuation of application Ser. No. 08/346,928 filed on Nov. 23, 1994, now abandoned.

BACKGROUND OF THE INVENTION

1. Field of the Invention

The present invention relates to a color photographic light-sensitive material, and more particularly, to a color photographic light-sensitive material for photography, which has a high storage stability and a high sensitivity and in which photographic properties vary little with the passing of time from photography to development.

2. Description of the Related Art

A number of studies have been conventionally made on spectral sensitivity distributions in order to improve the color reproducibility of color photographic light-sensitive materials. A silver halide color light-sensitive material includes blue-, green-, and red-sensitive layers having sensitivities to light components in their respective predetermined wavelength regions. However, the color sensitivity of each light-sensitive layer is not made constant in its wavelength region but changes depending on spectral sensitizing dyes or some other materials used. Therefore, different color light-sensitive materials that are commercially available have different spectral sensitivity distributions. For this reason, the peak position of the spectral sensitivity distribution or overlap of the skirts of the distribution changes with the choice and the combination of each of the light-sensitive layers. This is an important factor which dominates the color reproducibility of color light-sensitive materials. Usually, various spectral sensitizing dyes of each different weight-averaged wavelength are used in a silver halide color photographic light-sensitive material in order to obtain a desired spectral sensitivity distribution in each individual color-sensitive layer.

In the choice of spectral sensitizing dyes for use in each color-sensitive layer, whether a desired spectral sensitivity can be obtained is first taken into account as discussed above. However, since various properties such as the storage stability and the resistance to pressure of a light-sensitive material are largely influenced by the type of the dye used, this must also be taken into consideration. Unfortunately, no satisfactory research has been made on spectral sensitizing dyes whose barycentric wavelength ranges between 490 and 550 nm. Of oxacarbocyanine dyes and thiasimplecyanine dyes conventionally used as spectral sensitizing dyes for green- and blue-sensitive layers, respectively, those having barycentric wavelengths in the above-mentioned wavelength region are very few. In addition, these sensitizing dyes degrade the storage stability of light-sensitive materials. Especially when the light-sensitive materials are stored under relatively high-temperature, high-humidity conditions, a significant sensitivity decrease takes place. On the other hand, a relatively large number of simplecyanine dyes containing a 2-quinoline skeleton are available, which have barycentric wavelengths in the wavelength region described above and do not significantly degrade the storage stability of light-sensitive materials as compared with the oxacarbocyanine dyes or the thiasimplecyanine dyes.

Unfortunately, it is found that a large decrease in sensitivity occurs with the passage of time from photography to development if the simplecyanine dyes containing a 2-quinoline skeleton are used. Also, the sensitivity obtained when development is performed immediately after photography is still insufficient. At present, no satisfactory countermeasures have been made yet against these problems.

SUMMARY OF THE INVENTION

It is an object of the present invention to solve the above-mentioned problems brought about when spectral sensitization is performed by using a simplecyanine dye containing a 2-quinoline skeleton, and thereby provide a color photographic light-sensitive material which has a high storage stability and a high sensitivity and in which photographic properties vary little with the passing of time from photography to development.

The present inventors have made extensive studies and found that the object of the present invention is achieved by silver halide color photographic light-sensitive materials described below.

(1) A silver halide color photographic light-sensitive material which comprises, on a support, at least one blue-sensitive silver halide emulsion layer containing a yellow dye forming coupler, at least one green-sensitive silver halide emulsion layer containing a magenta dye forming coupler, and at least one red-sensitive silver halide emulsion layer containing a cyan dye forming coupler, wherein at least one light-sensitive silver halide emulsion layer is spectrally sensitized with at least one spectral sensitizing dye represented by Formula (I) below, and at least one silver halide emulsion contained in the light-sensitive silver halide emulsion layer is subjected to reduction sensitization in the manufacturing process of the emulsion:

Formula (I)

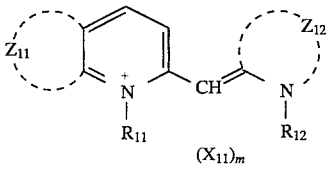

where $R_{11}$ and $R_{12}$ may be the same or different and each represent an alkyl group; $Z_{11}$ represents an atomic group required to form a benzene ring together with the carbon atoms; $Z_{12}$ represents an atomic group required to form, together with the nitrogen atom and the carbon atom, a benzothiazole nucleus, a benzoselenazole nucleus, a benzoxazole nucleus, or a naphthoxazole nucleus; $X_{11}$ represents a charge-balancing counter anion; and m represents 0 or 1, with m being 0 when an intramolecular salt is formed.

(2) The material described in item (1) above, wherein at least one silver halide emulsion contained in a light-sensitive silver halide emulsion layer, which is spectrally sensitized with at least one spectral sensitizing dye represented by Formula (I), is subjected to reduction sensitization in the manufacturing process of the emulsion, and added with at least one compound represented by Formula (II), (III), or (IV) below:

Formula (II)

$$R_{21}—SO_2—S—M$$

Formula (III)

$$R_{21}—SO_2—S—R_{22}$$

Formula (IV)

$$R_{21}—SO_2—S—L_m—S—SO_2—R_{23}$$

where $R_{21}$, $R_{22}$, and $R_{23}$ may be the same or different and each represents an aliphatic group, an aromatic group, or a heterocyclic group; M represents a cation; L represents a divalent linking group; and m represents 0 or 1, wherein compounds represented by Formulas (II) to (IV) may each form a polymer containing a divalent group derived from the structure represented by Formula (II), (III) or (IV) as a repeating unit.

(3) The material described in item (1) above, wherein at least one silver halide emulsion contained in a light-sensitive silver halide emulsion layer, which is spectrally sensitized with a combination of at least one compound represented by Formula (I) and at least one compound represented by Formula (V) or (VI) below, is subjected to reduction sensitization in the manufacturing process of the emulsion:

Formula (V)

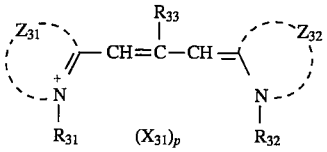

where $R_{31}$ and $R_{32}$ have the same meanings as $R_{11}$ and $R_{12}$ in Formula (I); $R_{33}$ represents a hydrogen atom, an alkyl group, or an aryl group; $Z_{31}$ and $Z_{32}$ may be the same or different and each represents an atomic group required to form a 5- or 6-membered nitrogen-containing heterocyclic ring together with the carbon atom and the nitrogen atom; and $X_{31}$ and p have the same meanings as $X_{11}$ and m, respectively, in Formula (I);

Formula (VI)

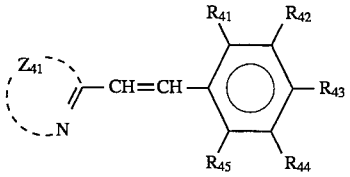

where $Z_{41}$ has the same meaning as $Z_{31}$ or $Z_{32}$ in Formula (V), and represents an atomic group required to form a 5- or 6-membered nitrogen-containing heterocyclic ring together with the carbon atom and the nitrogen atom; and each of $R_{41}$, $R_{42}$, $R_{43}$, $R_{44}$, and $R_{45}$ represents a substituted amino group, a hydrogen atom, a halogen atom, a hydroxy group, an alkyl group, an alkoxy group, or an aryl group, or every adjacent two of $R_{41}$ to $R_{45}$ may form a 5- or 6-membered ring together with the carbon atoms.

DETAILED DESCRIPTION OF THE PREFERRED EMBODIMENTS

The light-sensitive material of the present invention is preferably a silver halide color photographic light-sensitive material which is spectrally sensitized with a spectral sensitizing dye represented by Formula (I) described above, in order to give the material a color sensitivity to light in a wavelength region of 480 to 570 nm, preferably 490 to 550 nm.

The above color sensitivity corresponds to longer-wavelength components of blue-sensitive silver halide emulsion layers or to shorter-wavelength components of green-sensitive silver halide emulsion layers.

The spectral sensitizing dye represented by Formula (I) of the present invention can be used to spectrally sensitize any silver halide emulsion layer in the light-sensitive material of the present invention.

If a donor layer (CL) described in, e.g., U.S. Pat. No. 4,663,271 (which is incorporated herein by reference) or JP-A-62-160,448 ("JP-A" means Unexamined Published Japanese Patent Application) and having an interlayer effect on silver halide red-sensitive layers is to be arranged in a light-sensitive material to improve the color reproducibility, it is preferable that this donor layer has a maximum value of spectral sensitivity in a region of 510 to 530 nm. A compound represented by Formula (I) described above can be particularly preferably used in spectral sensitization of the donor layer.

An oxacarbocyanine dye has been conventionally used as a spectral sensitizing dye for the donor layer having an interlayer effect on silver halide red-sensitive layers. It has now been found that by replacing this conventional dye with a compound represented by Formula (I), the storage stability of light-sensitive materials can be significantly improved under high-temperature, high-humidity conditions.

In Formula (I), $Z_{11}$ represents an atomic group required to form a benzene ring together with the carbon atoms. At least one atom of the atomic group may be substituted with an alkyl group having 1 to 8 carbon atoms, preferably 1 to 5 carbon atoms, and more preferably, 1 to 3 carbon atoms, an alkoxy group having 1 to 8 carbon atoms, preferably 1 to 5 carbon atoms, and more preferably, 1 to 3 carbon atoms, an aryloxy group having 6 to 20 carbon atoms, preferably, 6 to 15 carbon atoms, and mote preferably, 6 to 10 carbon atoms, a halogen atom, an alkylthio group (ex. methylthio, ethylthio or propylthio, and preferably methylthio), an acyl group (ex. acetyl or propionyl), or a substituted amino group (ex. dimethyl amino or diethyl amino). Preferably, the 6-position of the benzene ring formed by $Z_{11}$ is substituted with an alkyl group having 1 to 3 carbon atoms. Examples of the alkyl group with which $Z_{11}$ is substituted are methyl, ethyl, n-propyl, isopropyl, t-butyl, n-butyl, n-octyl, n-decyl, n-hexadecyl, cyclopentyl, and cyclohexyl. The alkyl group is preferably methyl, ethyl or propyl.

The alkoxy group is, e.g., methoxy, ethoxy, propoxy, or methylenedioxy, and preferably methoxy.

The aryloxy group is, e.g., phenoxy, 4-methylphenoxy, or 4-chlorophenoxy, and preferably phenoxy.

$Z_{12}$ represents a group of atoms required to form a benzothiazole nucleus, a benzoselenazole nucleus, a benzoxazole nucleus, or a naphthoxazole nucleus, together with the carbon atom and the nitrogen atom. These nuclei may have a substituent. Examples of the substituents are a halogen atom, an alkyl group having 1 to 8 carbon atoms, preferably 1 to 5 carbon atoms, and more preferably 1 to 3 carbon atoms, an alkoxy group having 1 to 8 carbon atoms, preferably 1 to 5 carbon atoms, and more preferably 1 to 3 carbon atoms, an alkylthio group having 1 to 8 carbon atoms, preferably 1 to 5 carbon atoms, and more preferably 1 to 3 carbon atoms, or an aryl group having 6 to 20 carbon atoms, preferably 6 to 15 carbon atoms, and more preferably 6 to 10 carbon atoms. Examples of the halogen atom with which the nuclei are substituted are a fluorine atom, a chlorine atom, a bromine atom, and an iodine atom. The halogen atom is preferably a bromine atom or a chlorine atom.

The alkyl group may have a substituent. Examples of the alkyl group are methyl, ethyl, n-propyl, isopropyl, t-butyl, n-butyl, n-octyl, n-decyl, n-hexadecyl, cyclopentyl, cyclohexyl, trifluoromethyl, and hydroxyethyl. The alkyl group is preferably trifluoromethyl.

The alkoxy group is, e.g., methoxy, ethoxy, propoxy, or methylenedioxy, and preferably methoxy.

The alkylthio group is, e.g., methylthio, ethylthio, or propylthio, and preferably methylthio.

The aryl group is, e.g., phenyl group, pentafluorophenyl, 4-chlorophenyl, 3-sulfophenyl, or 4-methylphenyl, and preferably phenyl.

$Z_{12}$ preferably represents an atomic group required to form a benzothiazole nucleus whose 5-position is substituted with one of the substituents mentioned above.

In Formula (I), $R_{11}$ and $R_{12}$ may be the same or different and each represents an unsubstituted alkyl group (e.g., methyl, ethyl, propyl, butyl, pentyl, octyl, decyl, dodecyl, and octadecyl) having 18 or less carbon atoms, or a substituted alkyl group (i.e., an alkyl group having 18 or less carbon atoms and substituted with, e.g., a carboxy group, a sulfo group, a cyano group, a halogen atom (e.g., fluorine, chlorine, and bromine), a hydroxy group, an alkoxycarbonyl group (e.g., methoxycarbonyl, ethoxycarbonyl, and benzyloxycarbonyl) having 8 or less carbon atoms, an alkanesulfonylaminocarbonyl group having 8 or less carbon atoms, an acylaminosulfonyl group having 8 or less carbon atoms, an alkoxy group (e.g., methoxy, ethoxy, benzyloxy, and phenethyloxy) having 8 or less carbon atoms, an alkylthio group (e.g., methylthio, ethylthio, and methylthioethylthioethyl) having 8 or less carbon atoms, an aryloxy group (e.g., phenoxy, p-tolyloxy, 1-naphthoxy, and 2-naphthoxy) having 20 or less carbon atoms, an acyloxy group (e.g., acetyloxy and propionyloxy) having 3 or less carbon atoms, an acyl group (e.g., acetyl, propionyl, and benzoyl) having 8 or less carbon atoms, a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), or an aryl group (e.g., phenyl, 4-chlorophenyl, 4-methylphenyl, and a-naphthyl) having 20 or less carbon atoms.

Each of $R_{11}$ and $R_{12}$ is preferably an unsubstituted alkyl group having 1 to 6 carbon atoms (e.g., methyl, ethyl, n-propyl, n-butyl, n-pentyl, and n-hexyl), a carboxyalkyl group having 2 to 7 carbon atoms (e.g., 2-carboxyethyl and carboxymethyl), or sulfoalkyl having 1 to 6 carbon atoms (e.g., 2-sulfoethyl, 3-sulfopropyl, 4-sulfobutyl, and 3-sulfobutyl).

The alkyl group represented by $R_{11}$ and $R_{12}$ is more preferably a sulfoethyl group, a sulfopropyl group, a sulfobutyl group, a carboxymethyl group, or a carboxyethyl group.

In Formula (I), $X_{11}$ represents a charge-balancing counterion. An ion which counterbalances an intramolecular charge is selected from anions or cations. Examples of the anions are an inorganic or organic acid anion (e.g., p-toluenesulfonate, p-nitrobenzenesulfonate, methanesulfonate, methylsulfate, ethylsulfate, and perchlorate), and a halogen ion (e.g., chloride, bromide, and iodide). The cations include both inorganic and organic cations. Examples of the cations are a hydrogen ion, alkali metal ions (e.g., ions of lithium, sodium, potassium, and cesium), alkali earth metal ions (e.g., ions of magnesium, calcium, and strontium), and ammonium ions (e.g., ions of organic ammonium, triethanolammonium, and pyridinium).

m in Formula (I) represents 0 or 1. When an intramolecular salt is formed, m is 0.

In Formula (I), $Z_{12}$ is preferably an atomic group required to from a benzoxazole nucleus in order to impart a color sensitivity to a relatively short wavelength, in which case it is usually possible to impart a color sensitivity having a maximum value up to 515 nm. When $Z_{12}$ is an atomic group required to form a benzothiazole nucleus, a naphthoxazole nucleus, or a benzoselenazole nucleus, a color sensitivity to longer wavelengths than in the case of benzoxazole can be imparted. Normally, a color sensitivity with a maximum value of 510 nm or more can be imparted. It is possible to impart a color sensitivity having a maximum value of preferably 510 to 570 nm, and more preferably 520 to 550 nm.

Practical examples of a compound represented by Formula (I) are given below. However, sensitizing dyes which may be used in the present invention are not limited to these examples.

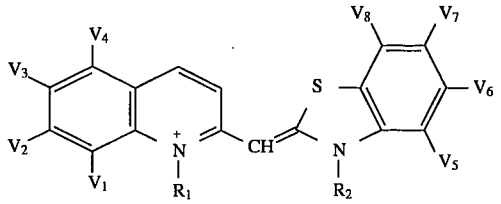

(X)

| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| I-1 | H | H | H | H | H | H | H | H | $C_2H_5$ | $C_2H_5$ | $I^-$ |
| I-2 | H | H | H | H | H | Cl | H | H | $C_2H_5$ | $-(CH_2)_4SO_3^-$ | — |
| I-3 | H | H | $CH_3$ | H | H | Cl | H | H | $-(CH_2)_4SO_3^-$ | $-(CH_2)_4SO_3^-$ | $\overset{+}{H}N(C_2H_5)_3$ |
| I-4 | H | H | $C_2H_5$ | H | H | 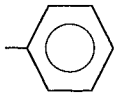 | H | H | $-CH_2COOH$ | $-(CH_2)_2SO_3^-$ | — |
| I-5 | H | H | 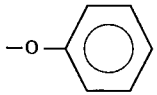 | H | H | Br | H | H | $-(CH_2)_3SO_3^-$ | $-CH_2CH_2CH(CH_3)SO_3^-$ | $K^+$ |
| I-6 | H | H | 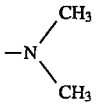 | H | H | Cl | $CH_3$ | H | $C_5H_{11}(n)$ | $-(CH_2)_4SO_3^-$ | — |
| I-7 | H | H | Cl | H | $OCH_3$ | H | H | H | $-(CH_2)_2SO_3^-$ | $-(CH_2)_2SO_3^-$ | $\overset{+}{H}N(C_2H_5)_3$ |
| I-8 | H | $CH_3$ | $CH_3$ | H | H | Cl | H | H | $-(CH_2)_4SO_3^-$ | $-(CH_2)_4SO_3^-$ | 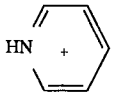 |
| I-9 | H | Cl | $CH_3$ | H | H | H | H | $OCH_3$ | $-(CH_2)_2-SCH_3$ | $-(CH_2)_3SO_3^-$ | — |
| I-10 | H | $CH_3$ | H | $CH_3$ | H | Cl | H | H | $-CH_2NHCOSO_2CH_3$ | $-(CH_2)_4SO_3^-$ | — |

-continued
| | | | | | | | | | | | |
|---|---|---|---|---|---|---|---|---|---|---|---|
| I-11 | $CH_3$ | H | $CH_3$ | H | H | $SCH_3$ | $SCH_3$ | H | $-(CH_2)_2-O-C_6H_5$ | $-(CH_2)_2-O-C_6H_5$ | $I^-$ |
| I-12 | H | H | $OCH_3$ | H | H | $OCH_3$ | H | H | $-(CH_2)_4SO_3^-$ | $-(CH_2)_4SO_3^-$ | $Li^+$ |
| I-13 | H | $SCH_3$ | $SCH_3$ | H | H | $COCH_3$ | H | H | $-(CH_2)_2COOH$ | $-(CH_2)_4SO_3^-$ | — |
I-14
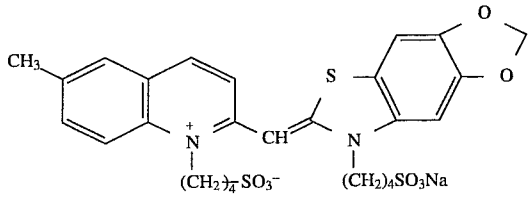
I-15
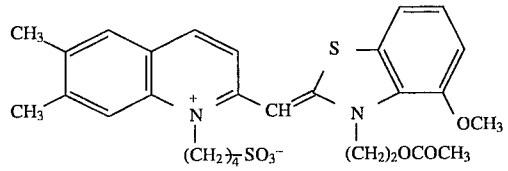
I-16
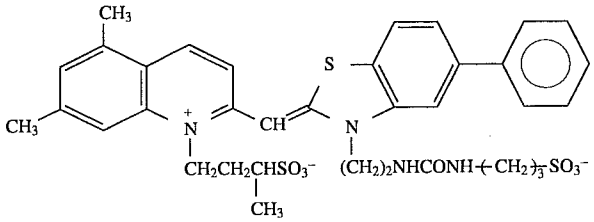

-continued

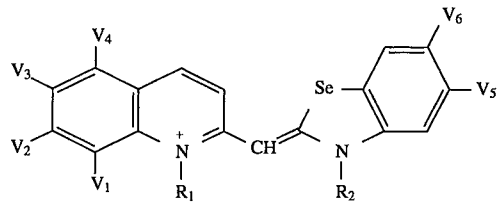

(X)

| No. | $V_1$ | $V_2$ | $V_3$ | $V_4$ | $V_5$ | $V_6$ | $R_1$ | $R_2$ | X |
|---|---|---|---|---|---|---|---|---|---|
| I-17 | H | H | H | H | H | H | $C_2H_5$ | $C_2H_5$ | $Br^-$ |
| I-18 | H | H | $CH_3$ | H | Cl | H | $-(CH_2)_4SO_3^-$ | $-(CH_2)_4SO_3^-$ | $Na^+$ |
| I-19 | H | $CH_3$ | $CH_3$ | H | Cl | $CH_3$ | $-CH_2CH_2CH(CH_3)SO_3^-$ | $C_2H_5$ | — |
| I-20 | $CH_3$ | H | $CH_3$ | H | 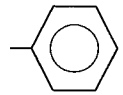 | H | $-(CH_2)_2CONHSO_2CH_3$ | $-(CH_2)_4SO_3^-$ | — |
| I-21 | H | $CH_3$ | H | $CH_3$ | Br | H | $-(CH_2)_2SO_3^-$ | $-(CH_2)_2SO_3^-$ | $\overset{+}{H}N(C_2H_5)_3$ |
| I-22 | H | H | $C_2H_5$ | H | H | $OCH_3$ | $-(CH_2)_2OH$ | $-(CH_2)_2OH$ | $Br^-$ |
| I-23 | H | H | Cl | H | H | $CH_3$ | $-(CH_2)_3SO_3^-$ | $-(CH_2)_2COOH$ | — |

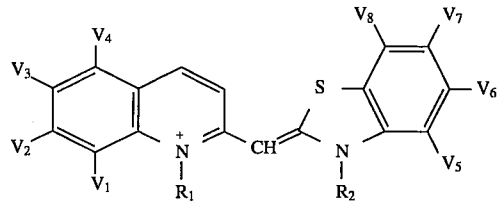

(X)

| No. | $V_1$ | $V_2$ | $V_3$ | $V_4$ | $V_5$ | $V_6$ | $V_7$ | $V_8$ | $R_1$ | $R_2$ | X |
|---|---|---|---|---|---|---|---|---|---|---|---|
| I-24 | H | H | H | H | H | Cl | H | H | $C_2H_5$ | $C_2H_5$ | $I^-$ |

-continued

| | | | | | | | | | | | |
|---|---|---|---|---|---|---|---|---|---|---|---|
| I-25 | H | H | H | H | H | Cl | H | H | $-(CH_2)_4SO_3^-$ | $-(CH_2)_4SO_3^-$ | $Na^+$ |
| I-26 | H | H | H | H | H | Cl | $CH_3$ | H | $-(CH_2)_3SO_3^-$ | $-(CH_2)_3SO_3^-$ | 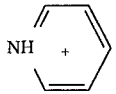 |
| I-27 | H | H | H | H | H | $-(CH_2)_2SO_3^-$ | H | H | $-(CH_2)_2SO_3^-$ | $-(CH_2)_2SO_3^-$ | $K^+$ |
| I-28 | H | H | $CH_3$ | H | H | 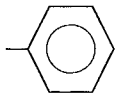 | H | H | $C_2H_5$ | $-(CH_2)_4SO_3^-$ | — |
| I-29 | H | H | $CH_3$ | H | H | Br | H | H | $-(CH_2)_3SO_3^-$ | $-(CH_2)_3SO_3^-$ | $Na^+$ |
| I-30 | H | H | $C_2H_5$ | H | H | $^tAm$ | H | H | $CH_2COOH$ | $-(CH_2)_4SO_3^-$ | — |
| I-31 | H | H | 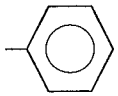 | H | Cl | H | H | H | $C_3H_7$ | $-CH_2CH_2\overset{CH_3}{\overset{\vert}{C}}HSO_3^-$ | — |
| I-32 | H | H | 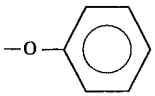 | H | H | H | Cl | H | $CH_3$ | $CH_3$ | 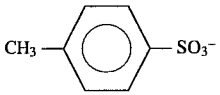 |
| I-33 | $CH_3$ | H | H | H | H | H | H | Cl | $C_2H_5$ | $-(CH_2)_4SO_3^-$ | — |
| I-34 | H | $CH_3$ | H | H | H | 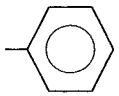 | $CH_3$ | H | $-(CH_2)_4SO_3^-$ | $-(CH_2)_3SO_3^-$ | $\overset{+}{H}N(C_2H_5)_3$ |
| I-35 | H | H | H | $CH_3$ | H | $OCH_3$ | H | H | $-(CH_2)_2COOH$ | $-(CH_2)_3SO_3^-$ | — |
| I-36 | H | $CH_3$ | H | $CH_3$ | H | 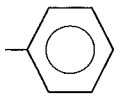 | H | H | $-(CH_2)_4SO_3^-$ | $-(CH_2)_4SO_3^-$ | $K^+$ |
| I-37 | H | H | Cl | H | H | Br | H | H | $-(CH_2)_4SO_3^-$ | $-(CH_2)_4SO_3^-$ | $H^+$ |

-continued
| | | | | | | | | | | | |
|---|---|---|---|---|---|---|---|---|---|---|---|
| I-38 | H | H | $-N(C_2H_5)_2$ | H | H | F | H | H | $CH_3$ | $CH_3$ | $I^-$ |
| I-39 | H | H | $CH_3$ | H | H | 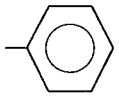 | H | H | $-(CH_2)_4SO_3^-$ | $-(CH_2)_4SO_3^-$ | $Na^+$ |
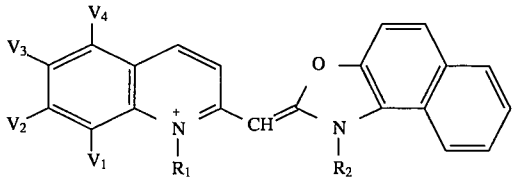
X
| No. | $V_1$ | $V_2$ | $V_3$ | $V_4$ | $R_1$ | $R_2$ | X |
|---|---|---|---|---|---|---|---|
| I-40 | H | H | H | H | $C_2H_5$ | $C_2H_5$ | $I^-$ |
| I-41 | H | H | H | H | $C_2H_5$ | $-(CH_2)_3SO_3^-$ | — |
| I-42 | H | H | $CH_3$ | H | $-(CH_2)_4SO_3^-$ | $-(CH_2)_3SO_3^-$ | $Na^+$ |
| I-43 | H | $CH_3$ | $CH_3$ | H | $-(CH_2)_4SO_3^-$ | $-(CH_2)_2SO_3^-$ | $Na^+$ |
| I-44 | H | H | 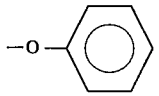 | H | $-(CH_2)_4SO_3^-$ | $CH_3$ | — |
| I-45 | H | $CH_3$ | H | $CH_3$ | $-(CH_2)_2SO_3^-$ | $-(CH_2)_3SO_3^-$ | $\overset{+}{H}N(C_2H_5)_3$ |
| I-46 | H | $C_2H_5$ | H | H | $CH_3$ | $CH_3$ | $I^-$ |
| I-47 | H | H | Cl | H | $^iC_3H_7$ | $C_2H_5$ | $Br^-$ |

-continued
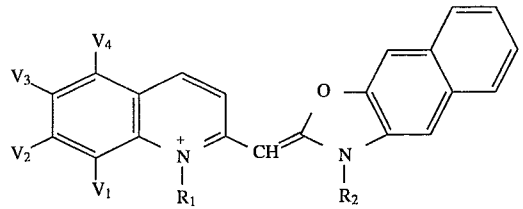
(X)
| No. | $V_1$ | $V_2$ | $V_3$ | $V_4$ | $R_1$ | $R_2$ | X |
|---|---|---|---|---|---|---|---|
| I-48 | H | H | H | H | $CH_3$ | $CH_3$ | $I^-$ |
| I-49 | H | H | $CH_3$ | H | $-(CH_2)_4SO_3^-$ | $-(CH_2)_4SO_3^-$ | $Na^+$ |
| I-50 | H | $CH_3$ | H | H | $-(CH_2)_2SO_3^-$ | $-(CH_2)_3SO_3^-$ | $\overset{+}{H}N(C_2H_5)_3$ |
| I-51 | H | $CH_3$ | H | $CH_3$ | $-(CH_2)_2COOH$ | $-(CH_2)_2SO_3^-$ | — |
| I-52 | H | H | 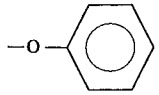 | H | $-(CH_2)_2SO_3^-$ | $(CH_2)_2SO_3^-$ | $Li^+$ |
| I-53 | H | H | Cl | H | $C_2H_5$ | $-(CH_2)_4SO_3^-$ | — |
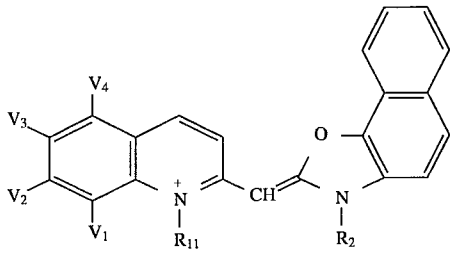
X
| No. | $V_1$ | $V_2$ | $V_3$ | $V_4$ | $R_1$ | $R_2$ | X |
|---|---|---|---|---|---|---|---|
| I-54 | H | H | H | H | $-(CH_2)_4SO_3^-$ | $-(CH_2)_4SO_3^-$ | $K^+$ |

-continued
| | | | | | | | |
|---|---|---|---|---|---|---|---|
| I-55 | H | H | $CH_3$ | H | $-(CH_2)_4SO_3^-$ | $-(CH_2)_2SO_3^-$ | 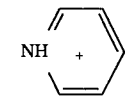 |
| I-56 | H | $CH_3$ | H | H | $CH_3$ | $C_2H_5$ | $I^+$ |
| I-57 | H | $CH_3$ | H | $CH_3$ | $C_5H_{11}(n)$ | $-(CH_2)_3SO_3^-$ | — |
| 1-58 | H | H | Cl | H | $-(CH_2)_4SO_3^-$ | $-(CH_2)_4SO_3^-$ | $Na^+$ |

A compound represented by Formula (I) of the present invention can be synthesized on the basis of the methods described in, e.g., F. M. Hamer, "Heterocyclic Compounds—Cyanine Dyes and Related Compounds," John Wiley & Sons, New York, London, 1964; D. M. Sturmer, "Heterocyclic Compounds—Special topics in heterocyclic chemistry," Chapter 18, Paragraph 14, pages 482 to 515, John Wiley & Sons, New York, London, 1977; and "Rodd's Chemistry of Carbon Compounds," 2nd ed., Vol. IV, part B, 1977, Chapter 15, pages 369 to 422 and 2nd. ed., Vol. IV, part B, 1985, Chapter 15, pages 267 to 296, Elsevier Science Publishing Company Inc., New York.

To allow spectral sensitizing dyes to be contained in silver halide emulsions, they can be dispersed directly in the emulsions. Alternatively, these spectral sensitizing dyes can be dissolved in one or a mixture of solvents, such as water, methanol, ethanol, propanol, methylcellosolve, 2,2,3,3-tetrafluoropropanol, and added in the solution form. It is also possible to prepare an aqueous solution of the dyes in the presence of an acid or a base and add the resultant solution to an emulsion, as described in JP-B-44-23389 ("JP-B" means Examined Published Japanese Patent Application), JP-B-44-27555, and JP-B-57-22089, or to prepare an aqueous solution or a colloid dispersion of the dyes in the presence of a surfactant and add the solution or the dispersion to an emulsion, as described in U.S. Pat. Nos. 3,822,135 and 4,006,025. In addition, it is possible to dissolve the dyes in a solvent which is substantially immiscible with water, disperse the solution in water or a hydrophilic colloid, and add the dispersion to an emulsion. Furthermore, as described in JP-A-53-102733 and JP-A-58-105141, it is possible to disperse the dyes directly in a hydrophilic colloid and add the resultant dispersion to an emulsion.

There are also a method in which water-insoluble dyes are dispersed in a water-soluble solvent without being dissolved and the resultant dispersion is added to an emulsion, as described in JP-B-46-24185, and a method in which water-insoluble dyes are mechanically milled and dispersed in a water-soluble solvent and the resultant dispersion is added to an emulsion, as described in JP-B-61-45217. The timing of addition to an emulsion can be any stage during the preparation of an emulsion, which is conventionally known to be useful. That is, the addition timing can be selected from any of before grain formation of a silver halide, during grain formation, from immediately after grain formation to before a washing step, before chemical sensitization, during chemical sensitization, from immediately after chemical sensitization to before setting of an emulsion by cooling, and during preparation of a coating solution. Most ordinarily, the addition is performed after the completion of chemical sensitization and before coating. As described in U.S. Pat. Nos. 3,628,969 and 4,225,666, the dyes can be added simultaneously with chemical sensitizers to perform spectral sensitization and chemical sensitization at the same time. Also, spectral sensitization can be performed prior to chemical sensitization as described in JP-A-58-113928, or started by adding the dyes before the completion of precipitation formation of silver halide grains. Furthermore, the spectral sensitizing dyes can be separately added as disclosed in U.S. Pat. Nos. 4,225,666. That is, it is possible to add a portion of the dyes prior to chemical sensitization and the rest of the dyes after the chemical sensitization. As discussed above, the dyes can be added at any point during grain formation of a silver halide, including the method disclosed in U.S. Pat. No. 4,183,756. Of these addition timings, the sensitizing dyes are preferably added before a washing step of an emulsion or before chemical sensitization.

The amount of a compound used, or of compounds used, represented by Formula (I) widely varies in accordance with the intended use. Practically, the amount is preferably $4\times10^{-6}$ to $2\times10^{-2}$ mol, and more preferably $5\times10^{-5}$ to $5\times10^{-3}$ mol per mol of silver halide.

In performing spectral sensitization by using a compound represented by Formula (I) in combination with other spectral sensitizing dyes, the ratio of a compound represented by Formula (I) in the total amount of the spectral sensitizing dyes is preferably 40 mol % or higher, and more preferably 70 mol % or higher.

The present inventors have made extensive studies and found that a higher spectral sensitivity can be given by a compound represented by Formula (I) when the compound is used together with a compound represented by Formula (V) or (VI) below.

Formula (V)

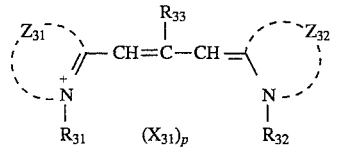

Formula (VI)

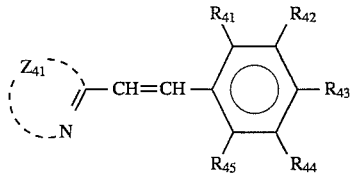

Examples of the nucleuses formed by $Z_{31}$ and $Z_{32}$ in Formula (V), respectively, are each a thiazole nucleus {a thiazole nucleus (e.g., thiazole, 4-methylthiazole, 4-phenylthiazole, 4,5-dimethylthiazole, 4,5-diphenylthiazole, and 3,4-dihydronaphtho[4,5-a]thiazole), a benzothiazole nucleus (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-phenoxybenzothiazole, 5-carboxybenzothiazole, 5-acetylbenzothiazole, 5-acetoxybenzothiazole, 5-phenethylbenzothiazole, 5-fluorobenzothiazole, 5-trifluoromethylbenzothiazole, 5-chloro-6-methylbenzothiazole, 5,6-dimethylbenzothiazole, 5,6-dimethoxybenzothiazole, 5,6-methylenedioxybenzothiazole, 5-hydroxy-6-methylbenzothiazole, tetrahydroxybenzothiazole, 4-phenylbenzothiazole, and 5,6-bismethylthiobenzothiazole), and a naphthothiazole nucleus (e.g., naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, and 8-methylthionaphtho[2,1-d]thiazole)}, a thiazoline nucleus (e.g., thiazoline, 4-methylthiazoline, and 4-nitrothiazoline), an oxazole nucleus {an oxazole nucleus (e.g., oxazole, 4-methyloxazole, 4-nitroxazole, 5-methyloxazole, 4-phenyloxazole, 4,5-diphenyloxazole, and 4-ethyloxazole), a benzoxazole nucleus (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 6-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole, and 5-acetylbenzoxazole), and a naphthoxazole nucleus (e.g., naphtho[2,1-d]oxazole, naphtho[1,2-d]oxazole, naphtho[2,3-d]oxazole, and 5-nitronaphtho[2,1-d]oxazole)}, an oxazoline nucleus (e.g., 4,4-dimethyloxazoline), a selenazole nucleus{a selenazole nucleus (e.g., 4-methylselenazole, 4-nitroselenazole, and 4-phenylselenazole), a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), and a naphthoselenazole nucleus (e.g., naphtho[2,1-d]selenazole and naphtho[1,2-d]selenazole}, a selenazoline nucleus (e.g., selenazoline and 4-methylselenazoline), a tellurazole nucleus {a tellurazole nucleus (e.g., tellurazole, 4-methyltellurazole, and 4-phenyltellurazole), a benzotellurazole nucleus (e.g., benzotellurazole, 5-chlorobenzotellurazole, 5-methylbenzotellurazole, 5,6-dimethylbenzotellurazole, and 6-methoxybenzotellurazole), and a naphthotellurazole nucleus (e.g., naphtho[2,1-d]tellurazole and naphtho[1,2-d]tellurazole)}, a tellurazoline nucleus (e.g., tellurazoline and 4-methyltellurazoline), a 3,3-dialkylindolenine nucleus (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), an imidazole nucleus (an imidazole nucleus (e.g., 1-alkylimidazole, 1-alkyl-4-phenylimidazole, and 1-arylimidazole), a benzimidazole nucleus (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, and 1-aryl-5-cyanobenzimidazole), and a naphthimidazole nucleus (e.g., alkylnaphtho[1,2-d]imidazole and 1-arylnaphtho[1,2-d]imidazole), a pyridine nucleus (e.g., 2-pyridine, 4-pyridine, 5-methyl-2-pyridine, and 3-methyl-4-pyridine), a quinoline nucleus {a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, 6-chloro-4-quinoline, and 5,6-dimethyl-4-quinoline), and an isoquinoline nucleus (e.g., 6-nitro-1-isoquinoline, 3,4-dihydro1-isoquinoline, and 6-nitro-3-isoquinoline)}, an imidazo[4,5-b]quinoxaline nucleus (e.g., 1,3-diethylimidazo[4,5-b]quinoxaline and 6-chloro-1,3-diallylimidazo[4,5-b]quinoxaline), an oxadiazole nucleus, a thiazole nucleus, a tetrazole nucleus, and a pyrimidine nucleus.

In the examples of the nuclei, the alkyl group is preferably one having one to eight carbon atoms, e.g., an unsubstituted alkyl group, such as methyl, ethyl, propyl, isopropyl, or butyl, or a hydroxyalkyl group (e.g., 2-hydroxyethyl and 3-hydroxypropyl), and most preferably methyl or ethyl, and the aryl group represents phenyl, halogen(e.g., chlorine)-substituted phenyl, alkyl(e.g., methyl)-substituted phenyl, or an alkoxy(e.g., methoxy)-substituted phenyl}.

Preferably, the nucleuses formed by $Z_{31}$ and $Z_{32}$, respectively, are a benzothiazole nucleus, a benzoxazole nucleus, a naphthoxazole nucleus, and a benzoimidazole nucleus.

$R_{31}$ and $R_{32}$ have the same meanings as $R_{11}$ and $R_{12}$ in Formula (I) and each preferably is sulfoethyl, sulfopropyl, sulfobutyl, carboxymethyl, or carboxyethyl.

$R_{33}$ represents a hydrogen atom, a substituted or unsubstituted alkyl group (e.g., methyl, ethyl, propyl, butyl, hydroxyethyl, trifluoromethyl, 2-chloroethyl, chloromethyl, methoxymethyl, 2-methoxyethyl, and benzyl), or a substituted or unsubstituted aryl group (e.g., phenyl, o-carboxyphenyl, p-tolyl, and m-tolyl). $R_{33}$ is preferably a hydrogen atom, a methyl group, or an ethyl group.

$X_{31}$ and p have the same meanings as $X_{11}$ and m, respectively, in Formula (I).

In Formula (VI), $Z_{41}$ has the same meaning as $Z_{31}$ or $Z_{32}$ in Formula (V), and $R_{41}$, $R_{42}$, $R_{43}$, $R_{44}$, and $R_{45}$ may be the same or different. Examples of $R_{41}$, $R_{42}$, $R_{43}$, $R_{44}$, and $R_{45}$ are a substituted amino group (e.g., diethylamino and hydroxyamino); an unsubstituted alkyl group (e.g., methyl, ethyl, propyl, butyl, pentyl, octyl, decyl, dodecyl, and octadecyl) having 18 or less carbon atoms; or a substituted alkyl group {an alkyl group having 18 or less carbon atoms and substituted with, e.g., a carboxy group, a sulfo group, a cyano group, a halogen atom (e.g., fluorine, chlorine, and bromine), a hydroxy group, an alkoxycarbonyl group (e.g., methoxycarbonyl, ethoxycarbonyl, and benzyloxycarbonyl) having 8 or less carbon atoms, an alkanesulfonylaminocarbonyl group having 8 or less carbon atoms, an acylaminosulfonyl group having 8 or less carbon atoms, an alkoxy group (e.g., methoxy, ethoxy, benzyloxy, and phenethyloxy) having 8 or less carbon atoms, an alkylthio group (e.g., methylthio, ethylthio, and methylthioethylthioethyl) having 8 or less carbon atoms, an aryloxy group (e.g., phenoxy, p-tolyloxy, 1-naphthoxy, and 2-naphthoxy) having 20 or less carbon atoms, an acyloxy group (e.g., acetyloxy and propionyloxy) having 3 or less carbon atoms, an acyl group (e.g., acetyl, propionyl, and benzoyl) having 8 or less carbon atoms, a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), or an aryl group (e.g., phenyl, 4-chlorophenyl, 4-methylphenyl, and α-naphthyl) having 20 or less carbon atoms}.

When every adjacent two of $R_{41}$ to $R_{45}$ form a 5- or 6-membered ring together with the carbon atoms, the 5- or 6-membered ring is preferably the ring formed with an alkylene group.

Each of $R_{41}$, $R_{42}$, $R_{43}$, $R_{44}$, and $R_{45}$ is preferably an unsubstituted alkyl group (e.g., a methyl group, an ethyl group, an n-propyl group, an n-butyl group, an n-pentyl group, and an n-hexyl group).

Practical examples of compounds represented by Formulas (V) and (VI) are presented below, but the compounds are not limited to these examples.

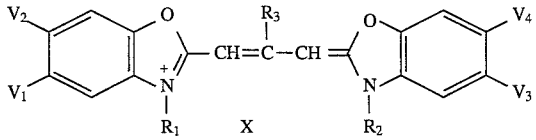

| No. | $V_1$ | $V_2$ | $V_3$ | $V_4$ | $R_1$ | $R_2$ | $R_3$ | X |
|---|---|---|---|---|---|---|---|---|
| V-1 | 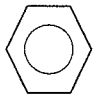 | H | 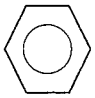 | H | $(CH_2)_2SO_3^-$ | $(CH_2)_2SO_3^-$ | $C_2H_5$ | 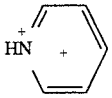 |
| V-2 | Cl | H | Cl | H | $(CH_2)_3SO_3^-$ | $(CH_2)_3SO_3^-$ | $C_2H_5$ | $Na^+$ |
| V-3 | 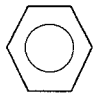 | H | Cl | H | $(CH_2)_2SO_3^-$ | $(CH_2)_4SO_3^-$ | $C_2H_5$ | $Na^+$ |
| V-4 | 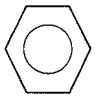 | H | $CH_3$ | H | $(CH_2)_2SO_3^-$ | $(CH_2)_4SO_3^-$ | $C_2H_5$ | $Na^+$ |
| V-5 | Cl | $CH_3$ | Cl | $CH_3$ | $-CH_2CH_2CH(CH_3)SO_3^-$ | $-CH_2CH_2CH(CH_3)SO_3^-$ | $C_2H_5$ | $HN^+(C_2H_5)_3$ |
| V-6 | Cl | H | Cl | H | $(CH_2)_2COOH$ | $(CH_2)_2COOH$ | $C_3H_7(n)$ | — |
| V-7 | 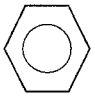 | H | Br | H | $C_2H_5$ | $(CH_2)_3SO_3^-$ | 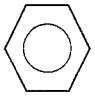 | — |
| V-8 | Br | H | Br | H | $C_2H_5$ | $C_2H_5$ | $C_2H_5$ | $I^-$ |

V-9

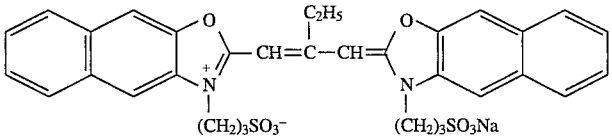

V-10

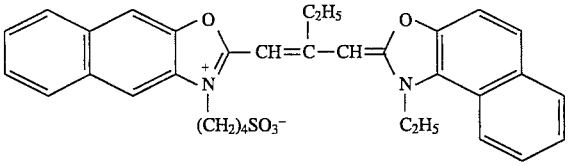

V-11

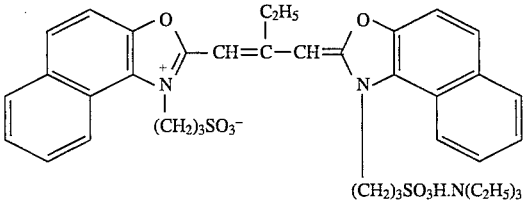

-continued
V-12
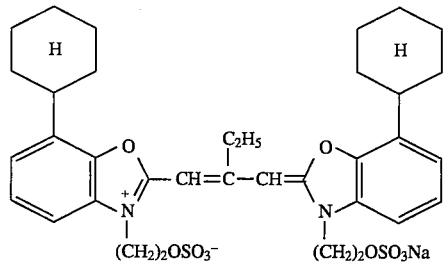
V-13
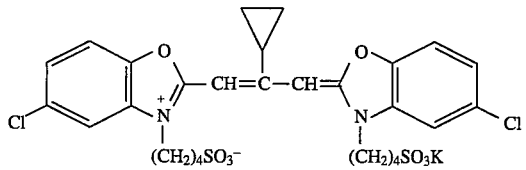
V-14
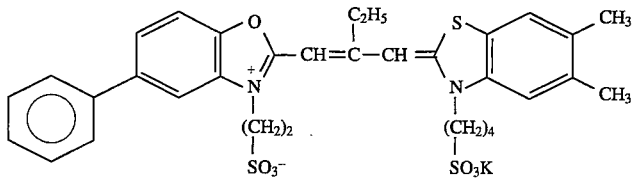
V-15
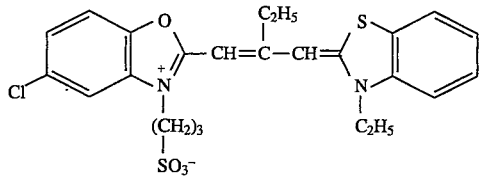
V-16
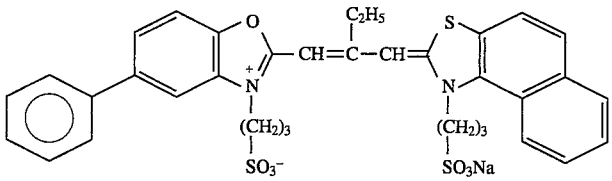
V-17
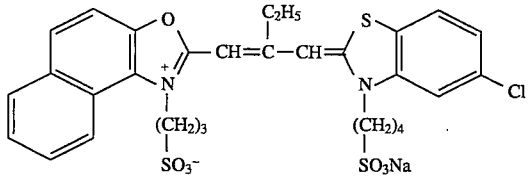
V-18
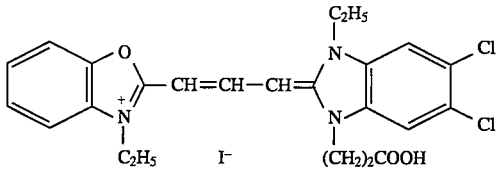
V-19
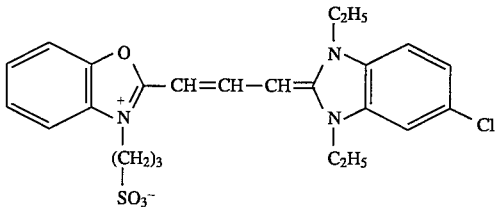

-continued
V-20
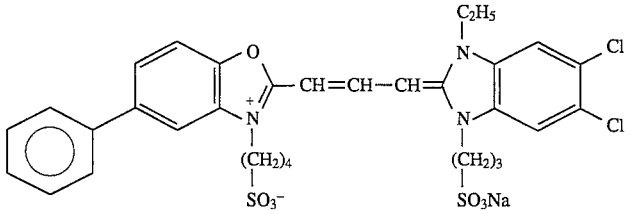
V-21
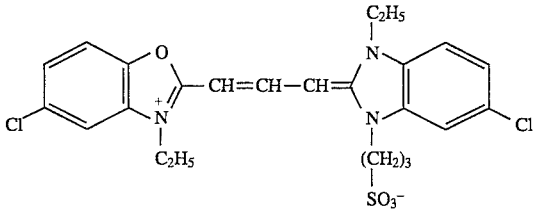
V-22
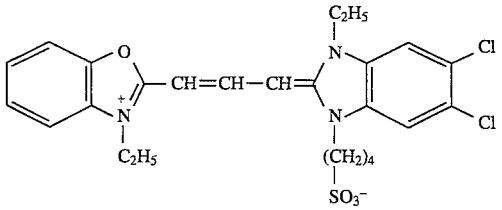
V-23
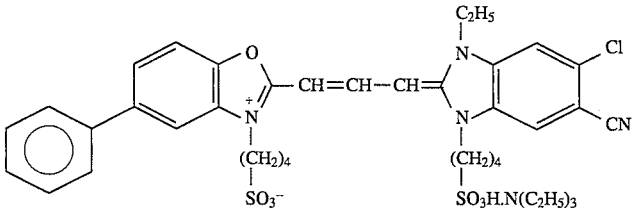
V-24
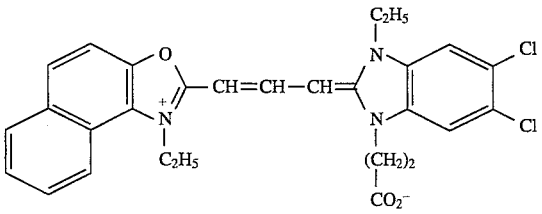
V-25
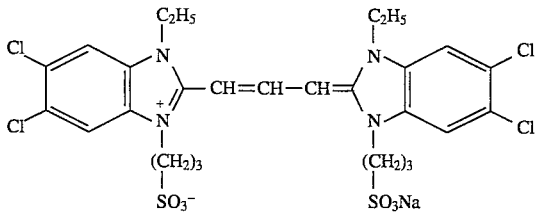
V-26
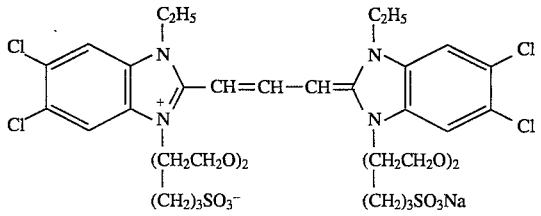

-continued
V-27
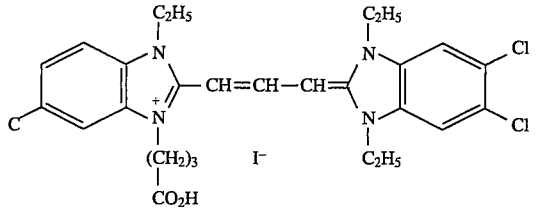
V-28
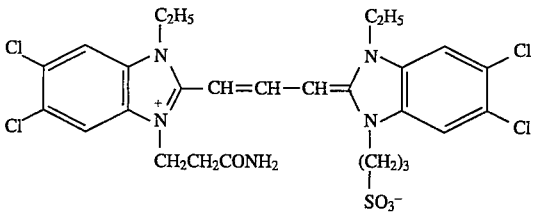
V-29
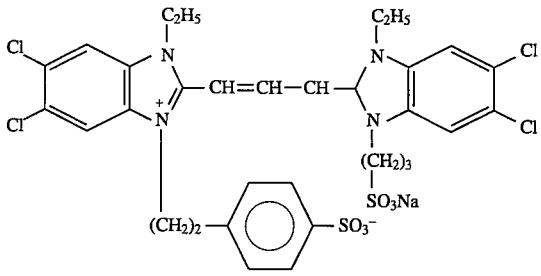
V-30
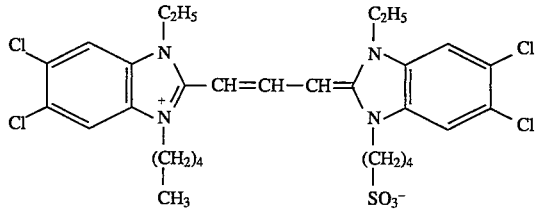
V-31
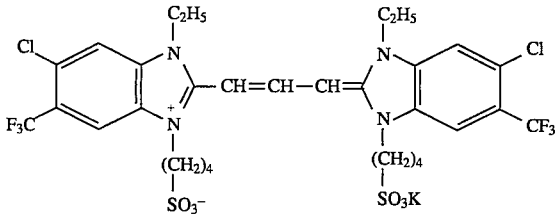
V-32
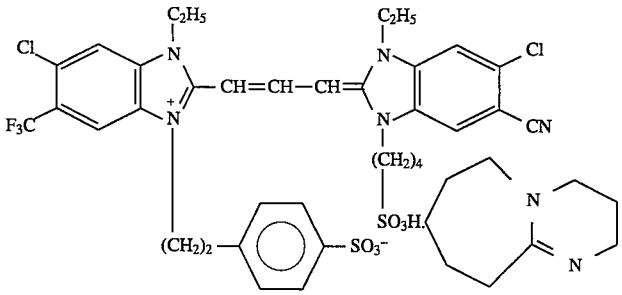
V-33
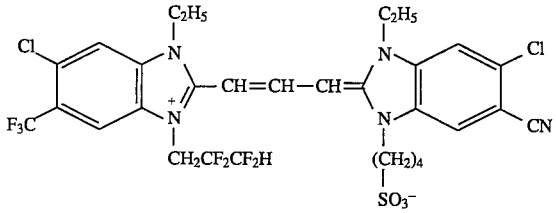

-continued

V-34

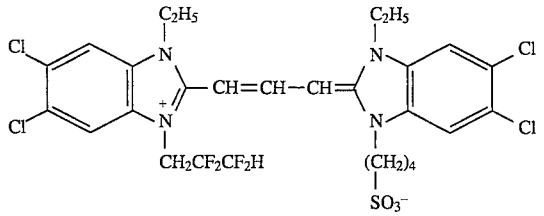

V-35

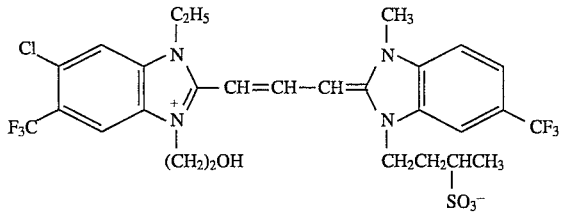

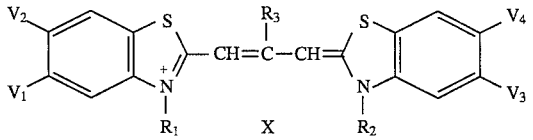

| No. | $V_1$ | $V_2$ | $V_3$ | $V_4$ | $R_1$ | $R_2$ | $R_3$ | X |
|---|---|---|---|---|---|---|---|---|
| V-36 | H | H | H | H | $C_2H_5$ | $C_2H_5$ | $CH_3$ | $Br^-$ |
| V-37 | Cl | H | Cl | H | $(CH_2)_2OH$ | $(CH_2)_2OH$ | $C_2H_5$ | $Br^-$ |
| V-38 | $CH_3$ | H | $CH_3$ | H | $(CH_2)_2OH$ | $(CH_2)_2OH$ | $C_2H_5$ | $Br^-$ |
| V-39 | Cl | H | Cl | H | $C_2H_5$ | $C_2H_5$ | $C_2H_5$ | 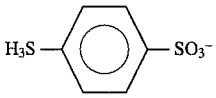 |
| V-40 | H | H | H | H | $C_2H_5$ | $(CH_2)_4SO_3^-$ | $CH_3$ | — |
| V-41 | $CH_3$ | H | $CH_3$ | H | $(CH_2)_3SO_3^-$ | $(CH_2)_3SO_3H$ | $C_2H_5$ | — |
| V-42 | Cl | $CH_3$ | Cl | $CH_3$ | $(CH_2)_4SO_3^-$ | $(CH_2)_4SO_3^-$ | $C_2H_5$ | $Na^+$ |
| V-43 | $OCH_3$ | H | 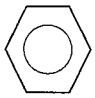 | H | $C_2H_5$ | $(CH_2)_3SO_3^-$ | $C_2H_5$ | — |
| V-44 | Cl | H | Cl | H | $(CH_2)_3SO_3^-$ | $(CH_2)_3SO_3^-$ | $C_2H_5$ | 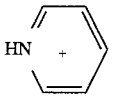 |
| V-45 | Cl | H | Cl | H | $C_2H_5$ | $(CH_2)_4SO_3^-$ | $C_2H_5$ | — |
| V-46 | Cl | H | COOH | H | $C_2H_5$ | $(CH_2)_4SO_3^-$ | $C_2H_5$ | — |
| V-47 | Cl | H | Cl | H | $(CH_2)_4SO_3^-$ | $-CH_2CONHSO_2CH_3$ | $C_2H_5$ | — |
| V-48 | 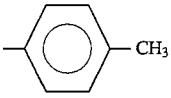 | H | 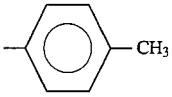 | H | $(CH_2)_4SO_3^-$ | $(CH_2)_4SO_3^-$ | $C_2H_5$ | $\overset{+}{H}N(C_2H_5)_3$ |

-continued
V-49
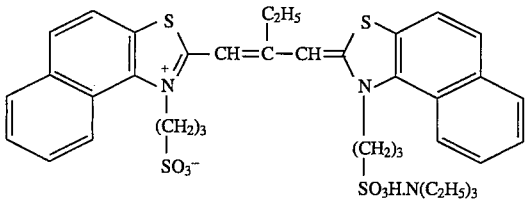
V-50
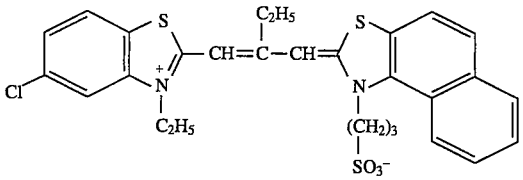
V-51
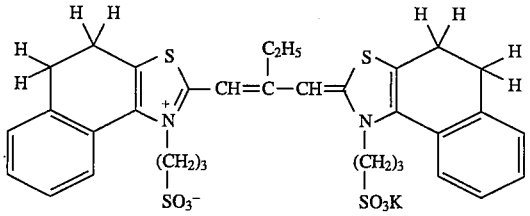
V-52
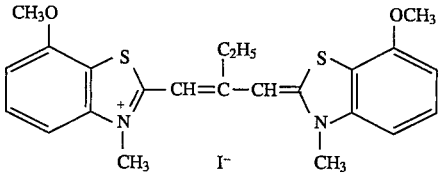
V-53
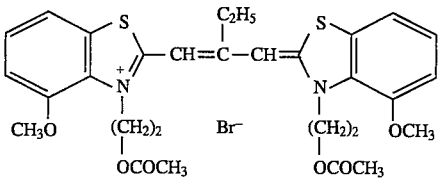
V-54
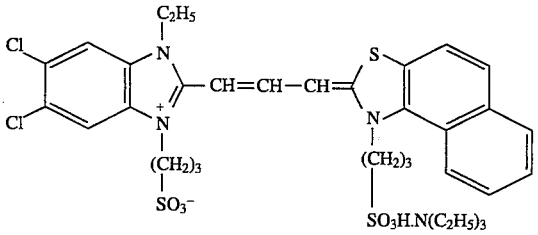
V-55
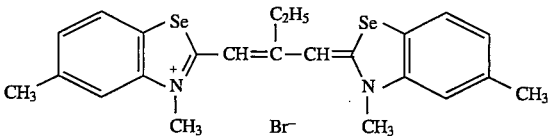
V-56
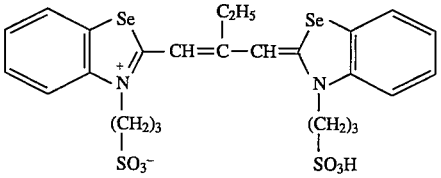

-continued

V-57

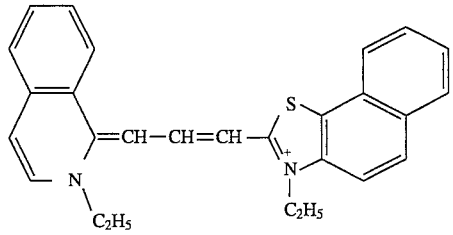

$I^-$

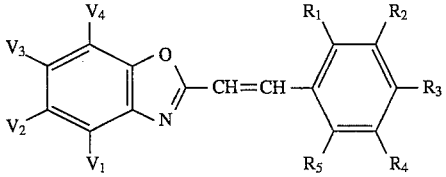

| No. | $V_1$ | $V_2$ | $V_3$ | $V_4$ | $R_1$ | $R_2$ | $R_3$ | $R_4$ | $R_5$ |
|---|---|---|---|---|---|---|---|---|---|
| VI-1 | H | H | H | H | H | H | $-N(CH_3)_2$ | H | H |
| VI-2 | H | Cl | H | H | H | H | $-N(C_2H_5)_2$ | H | H |
| VI-3 | H | 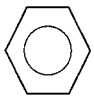 | H | H | H | H | $-N(CH_3)_2$ | H | H |
| VI-4 | H | Cl | $CH_3$ | H | H | H | F | H | H |
| VI-5 | H | H | Cl | H | H | $CH_3$ | H | $CH_3$ | H |
| VI-6 | H | H | H | Cl | H | H | $OCH_3$ | H | H |
| VI-7 | $CH_3$ | H | H | H | OH | H | OH | H | H |
| VI-8 | H | $COCH_3$ | H | H | H | H | 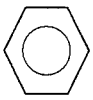 | H | H |
| VI-9 | H | $OCH_3$ | H | H | $CH_3$ | H | H | H | $CH_3$ |
| VI-10 | H | $^tBu$ | H | H | H | H | Br | H | H |

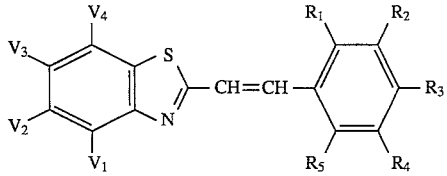

| No. | $V_1$ | $V_2$ | $V_3$ | $V_4$ | $R_1$ | $R_2$ | $R_3$ | $R_4$ | $R_5$ |
|---|---|---|---|---|---|---|---|---|---|
| VI-11 | H | H | H | H | H | H | $-N(CH_3)_2$ | H | H |
| VI-12 | H | Cl | H | H | H | H | $-N(C_2H_5)_2$ | H | H |
| VI-13 | H | 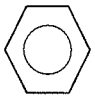 | H | H | $CH_3$ | H | $CH_3$ | H | H |
| VI-14 | H | Cl | $CH_3$ | H | H | $CH_3$ | H | $CH_3$ | H |
| VI-15 | H | $SCH_3$ | $SCH_3$ | H | H | H | Cl | H | H |
| VI-16 | H | H | H | $OCH_3$ | Cl | H | H | Cl | H |
| VI-17 | $OCH_3$ | H | H | H | $OCH_3$ | H | H | H | H |
| VI-18 | H | $OCOCH_3$ | H | H | H | H | Br | H | H |
| VI-19 | H | $OC_2H_5$ | H | H | H | H | 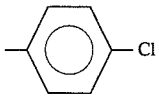 | H | H |

-continued

| | | | | | | | | | |
|---|---|---|---|---|---|---|---|---|---|
| VI-20 | H | $CH_3$ | $CH_3$ | H | H | H | $H_3C$ | H | H |
| VI-21 | 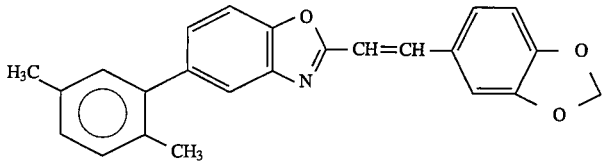 | | | | | | | | |
| VI-22 | 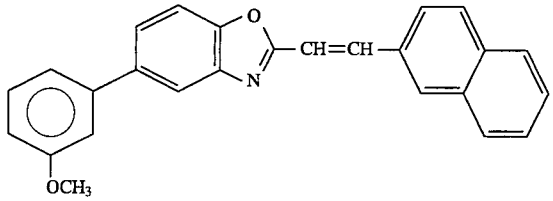 | | | | | | | | |
| VI-23 | 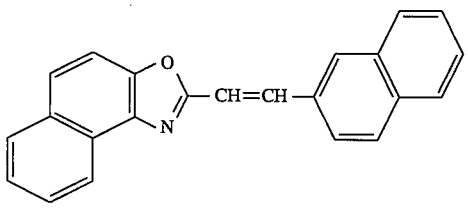 | | | | | | | | |
| VI-24 | 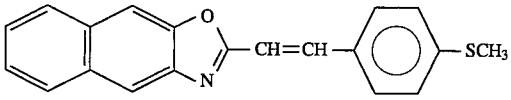 | | | | | | | | |
| VI-25 | 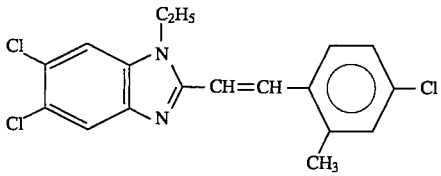 | | | | | | | | |
| VI-26 | 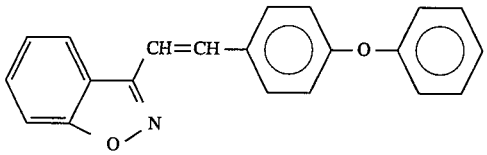 | | | | | | | | |
| VI-27 | 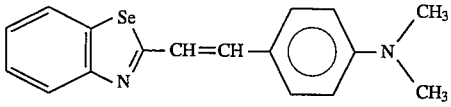 | | | | | | | | |
| VI-28 | 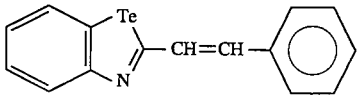 | | | | | | | | |

A compound represented by Formula (V) or (VI) can be used together with a compound represented by Formula (I) at any suitable mixing ratio. The total amount of compound represented by Formula (V) and/or (VI) is preferably 3 to 50 mol % of the amount of compound represented by Formula (I).

To decrease variations in photographic properties with the passage of time from photography to development, which is one objective of the present invention, it is necessary to use a silver halide emulsion which is subjected to reduction sensitization in a light-sensitive silver halide emulsion layer to be spectrally sensitized by using a compound represented by Formula (I).

When spectral sensitization is performed for a layer containing an emulsion not being reduction sensitized, by using a 2-quinocyanine dye represented by Formula (I), a large decrease in the sensitivity results with the passing of time from photography to development. However, it has been found that the use of a silver halide emulsion subjected to reduction sensitization in combination with the use of the 2-quinocyanine dye makes it possible to significantly suppress this decrease in sensitivity. Consequently, variations in photographic properties with the elapse of time from photography to development of the photographic material of the present invention become smaller than when spectral sensitization is performed solely with an oxacarbocyanine dye or a thiasimplecyanine dye.

It has also been found that a lowering in sensitivity taking place when a light-sensitive material is stored under high-temperature, high-humidity conditions is suppressed by reduction sensitization performed on an emulsion sensitized with a dye of Formula (I). In contrast, a lowering in sensitivity is accelerated after storage under high-temperature, high-humidity conditions when spectral sensitization is performed by using an oxacarbocyanine dye or a thiasimplecyanine dye if reduction sensitization is performed. This demonstrates that the improvement in storage stability achieved by reduction sensitization conducted in the present invention is the characteristic advantage attained by the photographic material of the present invention.

It is known that silver halide emulsions with a high sensitivity can be obtained by reduction sensitization. However, the effect of raising the sensitivity is more remarkable when spectral sensitization is performed with a 2-quinocyanine dye represented by Formula (I) than when spectral sensitization is performed solely with an oxacarbocyanine dye or a thiasimplecyanine dye, indicating the characteristic feature of the present invention.

Reduction-sensitized emulsions for use in the present invention will be described below.

The process of manufacturing a silver halide emulsion is roughly divided into steps of grain formation, desairing, and chemical sensitization. The grain formation step is subdivided into nucleation, ripening, and growing. These steps are not performed in a predetermined order but performed in a reverse order or repeatedly. Performing reduction sensitization during the manufacturing process of a silver halide emulsion means that the reduction sensitization can be basically performed in any of these steps. That is, the reduction sensitization can be performed during nucleation or physical ripening, as the initial stages of the grain formation, during growing, or prior to or after chemical sensitization. If chemical sensitization is to be performed in combination with gold sensitization, the reduction sensitization is preferably performed before the chemical sensitization so that undesired fog is not produced. Most preferably, the reduction sensitization is performed during growing of silver halide grains. This method of performing reduction sensitization during growing includes a method of performing reduction sensitization while silver halide grains are being physically ripened or being grown upon addition of water-soluble silver salt and water-soluble alkaline metal halide, and a method of performing reduction sensitization while temporarily stopping growing and then performing growing again.

The reduction sensitization of the present invention can be selected from any of a method of adding known reducing agents to a silver halide emulsion, a method called silver ripening in which growing or ripening is performed in a low-pAg ambient with a pAg of 1 to 7, and a method called a high-pH ripening in which growing or ripening is performed in a high-pH ambient with a pH of 8 to 11. Two or more of these methods can be performed together.

The method of adding reduction sensitizers is preferable because the level of reduction sensitization can be finely controlled.

Known examples of the reduction sensitizers are a stannous salt, amines and polyamines, a hydrazine derivative, formamidinesulfinic acid, a silane compound, and a borane compound. These known compounds can be selectively used in the present invention, or two or more types of these compounds can be used together. Preferable compounds as the reduction sensitizer are stannous chloride, thiourea dioxide, dimethylamineborane, and ascorbic acid and its derivative. The reduction sensitizer is particularly preferably thiourea dioxide or ascorbic acid.

Although the addition amount of these sensitizers must be so selected as to meet the emulsion preparing conditions, it is preferably $10^{-7}$ to $10^{-2}$ mol per mol of silver halide.

If the reduction sensitizer is thiourea dioxide, the addition amount is preferably $5.0\times10^{-7}$ to $1.0\times10^{-4}$ mol per mol of a silver halide. If the reduction sensitizer is ascorbic acid, the addition amount is preferably, $5.0\times10^{-5}$ to $5.0\times10^{-3}$ mol per mol of a silver halide.

The reduction sensitizers can be added by dissolving in water or a solvent, such as alcohols, glycols, ketones, esters, or amides, and adding the resultant solution during grain formation or before or after chemical sensitization. Although the reduction sensitizers can be added to a reactor vessel in advance, it is more preferable to add them at an appropriate timing during grain formation, particularly, immediately before or during grain growth. It is also possible to add the reduction sensitizers to an aqueous solution of water-soluble silver salt or water-soluble alkaline metal halide and perform grain formation by using the solutions. Alternatively, it is preferable to add the solution of reduction sensitizers divisionally several times or successively over a long time period as grain formation progresses.

The present inventors have made extensive studies and found that in the present invention the addition of at least one type of a thiosulfonate compound represented by Formula (II), (III), or (IV) presented below in the process of manufacturing a reduction sensitized emulsion is preferable in order to improve the storage stability of a light-sensitive material and to reduce variations in photographic properties with the passage of time from photography to development, as the objects of the present invention. Addition of a compound represented by Formula (II) is most preferable.

Formula (II)

$$R_{21}—SO_2—S—M$$

Formula (III)

$$R_{21}—SO_2—S—R_{22}$$

Formula (IV)

$$R_{21}—SO_2—S—L_m—S—SO_2—R_{23}$$

wherein $R_{21}$, $R_{22}$, and $R_{23}$ may be the same or different and each represents an aliphatic group, an aromatic group, or a heterocyclic group, M represents a cation, L represents a divalent binding group, and m represents 0 or 1.

Compounds represented by Formulas (II) to (IV) may each form a polymer containing a divalent group derived from the structure represented by Formula (II), (III) or (IV) as a repeating unit. If appropriate, $R_{21}$ and M in Formula (II) may combine to form a ring; $R_{21}$ and $R_{22}$ in Formula (III) may combine to form a ring; and $R_{21}$ and $R_{23}$ in Formula (IV) may combine to form a ring.

Thiosulfonic acid-based compounds represented by Formula (II), (III), or (IV) will be described in more detail below. If each of $R_{21}$, $R_{22}$, and $R_{23}$ is an aliphatic group, this aliphatic group is a saturated or unsaturated and straight-chain, branched, or cyclic aliphatic hydrocarbon group, preferably an alkyl group having 1 to 22 carbon atoms, an alkenyl group having 2 to 22 carbon atoms, or an alkynyl group having 2 to 22 carbon atoms. These groups can have substituents. Examples of the alkyl group are methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of the alkenyl group are allyl and butenyl.

Examples of the alkinyl group are propargyl and butynyl.

An aromatic group represented by $R_{21}$, $R_{22}$, or $R_{23}$ includes a monocyclic or condensed-ring aromatic group, preferably one having 6 to 20 carbon atoms, for example, phenyl and naphthyl. These aromatic groups may be substituted.

A heterocyclic group represented by $R_{21}$, $R_{22}$, or $R_{23}$ is a 3- to 15-membered, preferably 3- to 6-membered ring having at least one element selected from nitrogen, oxygen, sulfur, selenium, and tellurium and at least one carbon atom. Examples are pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, and thiadiazole rings.

Examples of substituents for $R_{21}$, $R_{22}$, and $R_{23}$ are an alkyl group (e.g., methyl, ethyl, and hexyl), an alkoxy group (e.g., methoxy, ethoxy, and octyloxy), an aryl group (e.g., phenyl, naphthyl, and tolyl), a hydroxy group, a halogen atom (e.g., fluorine, chlorine, bromine, and iodine), an aryloxy group (e.g., phenoxy), an alkylthio group (e.g., methylthio and butylthio), an arylthio group (e.g., phenylthio), an acyl group (e.g., acetyl, propionyl, butyryl, and varelyl), a sulfonyl group (e.g., methylsulfonyl and phenylsulfonyl), an acylamino group (e.g., acetylamino and benzoylamino), a sulfonylamino group (e.g., methanesulfonylamino and benzenesulfonylamino), an acyloxy group (e.g., acetoxy and benzoxy), a carboxyl group, a cyano group, a sulfo group, an amino group, an $—SO_2SM$ group (M represents a monovalent cation), and an $—SO_2R$ group (R represent an alkyl group).

A divalent binding group represented by L is an atom or an atom group containing at least one of C, N, S, and O. Examples are an alkylene group, an alkenylene group, an alkinylene group, an arylene group, —O—, —S—, —NH—, —CO—, and $SO_2$—, and combinations of these.

L is preferably a divalent aliphatic group or a divalent aromatic group. Examples of the divalent aliphatic group represented by L are $—(CH_2)_n$- (n is 1 to 12), —CH2—CH=CH—$CH_2$—, —$CH_2C{\equiv}CCH_2$—, —$CH_2$-1,4-cyclohexylene-$CH_2$—, and a xylylene group. Examples of the divalent aromatic group represented by L are a phenylene group and a naphthylene group.

These substituents can be further substituted by the substituents described so far.

M is preferably a metal ion or an organic cation. Examples of the metal ion are a lithium ion, a sodium ion, and a potassium ion. Examples of the organic cation are an ammonium ion (e.g., ammonium, tetramethylammonium, and tetrabutylammonium), a phosphonium ion (e.g., tetraphenylphosphonium), and a guanidyl group.

When compounds represented by Formulas (II) to (IV) are polymers, examples of repeating units of the polymers are as follows.

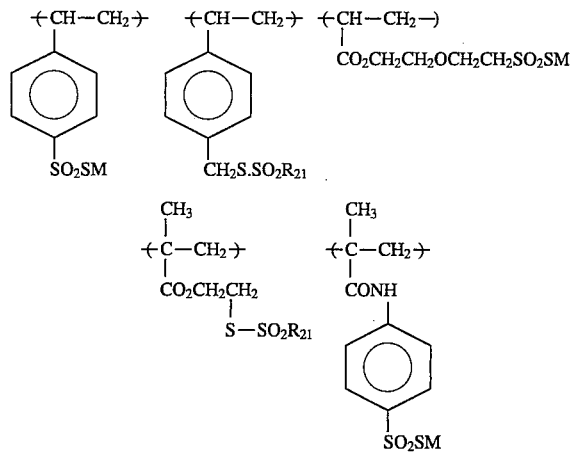

These polymers may be homopolymers or copolymers with other copolymerized monomers.

Practical examples of compounds represented by Formulas (II), (III), or (IV) are presented below, but the compounds are not limited to these examples.

Compounds represented by Formulas (II), (III), and (IV) can be readily synthesized by the methods described in JP-A-54-1019; British Patent 972,211; and Journal of Organic Chemistry, Vol. 53, p. 396 (1988) or the modified method thereof.

$CH_3SO_2SNa$ (II-1)

$C_2H_5SO_2SNa$ (II-2)

$C_3H_7SO_2SK$ (II-3)

$C_4H_9SO_2SLi$ (II-4)

$C_6H_{13}SO_2SNa$ (II-5)

$C_8H_{17}SO_2SNa$ (II-6)

$CH_3(CH_2)_3CH(C_2H_5)CH_2SO_2S.NH_4$ (II-7)

$C_{10}H_{21}SO_2SNa$ (II-8)

$C_{12}H_{25}SO_2SNa$ (II-9)

$C_{16}H_{33}SO_2SNa$ (II-10)

$(CH_3)_2CH—SO_2SK$ (II-11)

t-$C_4H_9SO_2SNa$ (II-12)

$CH_3OCH_2CH_2SO_2S.Na$ (II-13)

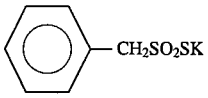
(II-14)

$CH_2{=}CHCH_2SO_2SNa$ (II-15)

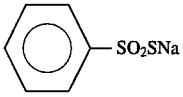
(II-16)

-continued
(II-17)
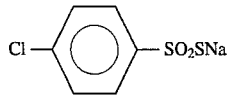
(II-18)
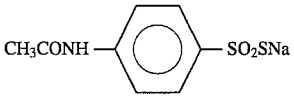
(II-19)
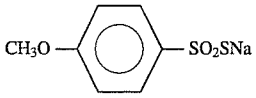
(II-20)
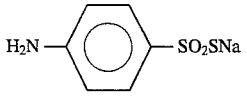
(II-21)
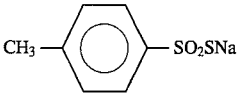
(II-22)
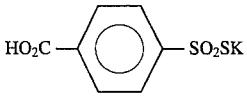
(II-23)
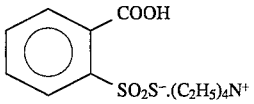
(II-24)
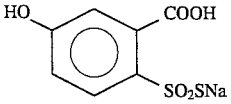
(II-25)
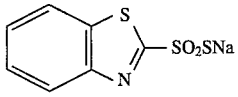
(II-26)
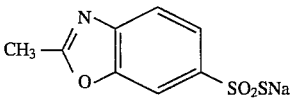
(II-27)
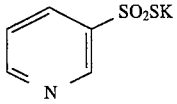
(II-28)
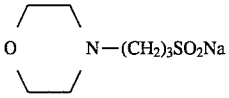
$NaSSO_2(CH_2)_2SO_2SK$ (II-29)
$NaSSO_2(CH_2)_4SO_2SNa$ (II-30)
$NaSSO_2(CH_2)_4S(CH_2)_4SO_2SNa$ (II-31)
(II-32)
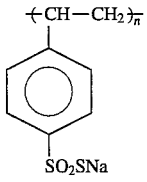
-continued
(II-33)
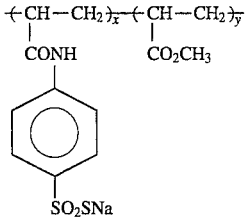
x/y = 1/1 (molar ratio)
$C_2H_5SO_2S-CH_3$ (III-1)
$C_8H_{17}SO_2SCH_2CH_3$ (III-2)
(III-3)
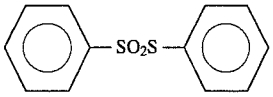
(III-4)
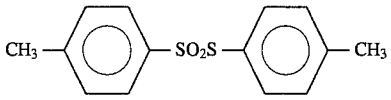
$C_2H_5SO_2SCH_2CH_2CN$ (III-5)
(III-6)
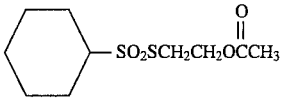
(III-7)
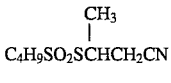
(III-8)
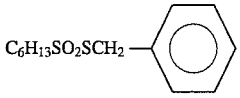
(III-9)
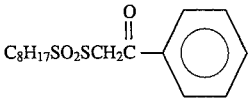
(III-10)
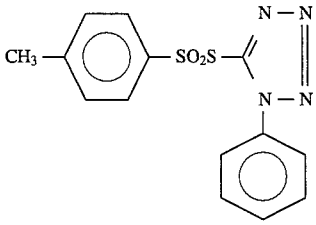
(III-11)
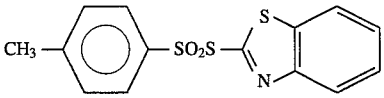
(III-12)
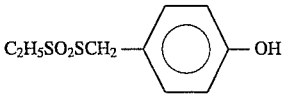
(III-13)
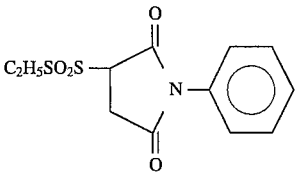

-continued (III-14)

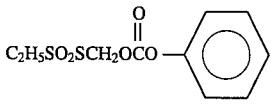

(III-15)

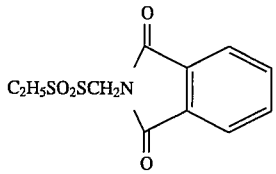

(III-16)

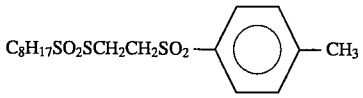

(III-17)

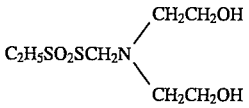

(III-18)

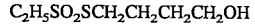

(III-19)

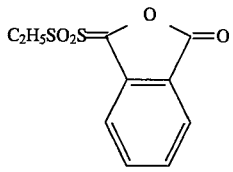

(III-20)

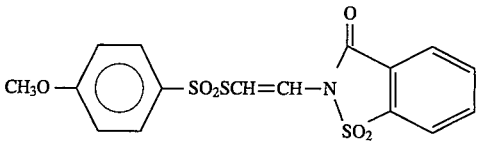

(III-21)

(III-22)

(III-23)

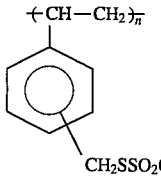

(III-24)

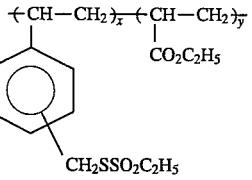

x/y = 2/1 (molar ratio)

(III-25)

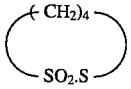

(IV-1)

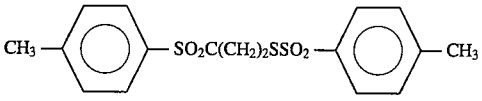

(IV-2)

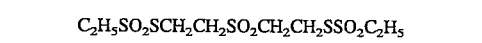

-continued (IV-3)

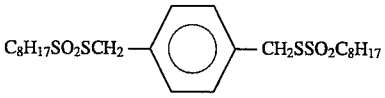

(IV-4)

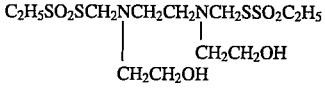

(IV-5)

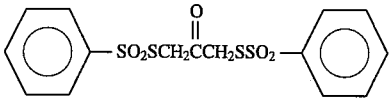

(IV-6)

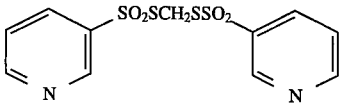

(IV-7)

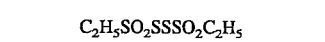

(IV-8)

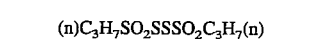

(IV-9)

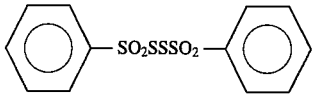

A compound represented by Formula (II), (III), or (IV) is added in an amount of preferably $10^{-7}$ to $10^{-1}$, more preferably $10^{-6}$ to $10^{-2}$, and most preferably $10^{-5}$ to $10^{-3}$ mol per mol of silver halide. A compound represented by Formula (II), (III), or (IV) can be added during grain formation, before chemical sensitization, or after chemical sensitization of a silver halide emulsion. The compound is added preferably before chemical sensitization, and more preferably during grain formation.

Also, a compound represented by Formula (II), (III), or (IV) can be added either before or after the beginning of reduction sensitization. However, it is preferable that a compound be added after the beginning of reduction sensitization.

To add compounds represented by Formulas (II) to (IV) during the manufacturing process, methods commonly used in placing additives in photographic emulsions can be applied. For example, water-soluble compounds can be added in the form of aqueous solutions at appropriate densities, and compounds which are insoluble or sparingly soluble in water can be added in the from of solutions by dissolving in organic solvents, which are miscible with water and have no adverse effects on photographic properties, such as alcohols, glycols, ketones, esters, and amides.

The silver halide composition of grains for use in light-sensitive silver halide emulsion layers of the photographic light-sensitive material of the present invention is silver bromide, silver chloride, silver iodide, silver chlorobromide, silver iodochloride, silver bromoiodide, or silver bromochloroiodide. The silver halide grain may contain another silver salt, such as silver rhodanate, silver sulfide, silver selenide, silver carbonate, silver phosphate, or an organic acid silver, as another grain or as a portion of the grain. If rapid development and desilvering (bleaching, fixing, and bleach-fix) steps are desired, silver halide grains containing a large quantity of silver chloride are desirable. To appropriately discourage development, silver halide grains are preferably made contain silver iodide. The content of silver chloride is preferably 1 to 30 mol %, more preferably 5 to 20 mol %, and most preferably 8 to 15 mol %. Making silver bromoiodide grains further contain silver chloride is preferable to reduce lattice strains.

The silver halide emulsion of the present invention preferably has a distribution or a structure in association with a halogen composition in its grains. A typical example of such a grain is a core-shell or double structure grain having different halogen compositions in its interior and surface layer as disclosed in, e.g., JP-B-43-13162, JP-A-61-215540, JP-A-60-222845, JP-A-60-143331, or JP-A-6]-75337. The structure need not be a simple double structure but may be a triple structure or a multiple structure larger than the triple structure as disclosed in JP-A-60-222844. It is also possible to bond silver halide in thin layer having a different composition from that of a core-shell double-structure grain on the surface of the grain.

The structure to be formed inside a grain need not be the surrounding structure as described above but may be a so-called junctioned structure. Examples of the junctioned structure are disclosed in JP-A-59-133540, JP-A-58-108526, EP 199,290A2, JP-B-58-24772, and JP-A-59-16254. A crystal to be junctioned can be formed on the edge, the corner, or the face of a host crystal to have a different composition from that of the host crystal. Such a junctioned crystal can be formed regardless of whether a host crystal is uniform in halogen composition or has a core-shell structure.

In the case of the junctioned structure, it is naturally possible to use a combination of silver halides. However, it is also possible to form the junctioned structure by combining a silver halide and a silver salt compound not having a rock salt structure, such as silver rhodanate or silver carbonate. In addition, a non-silver salt compound, such as lead oxide, can also be used provided that formation of the junctioned structure is possible.

In a silver bromoiodide grain having any of the above structures, it is preferable that the silver iodide content in a core portion be higher than that in a shell portion. In contrast, it is sometimes preferable that the silver iodide content in the core portion be lower than that in the shell portion. Similarly, in a junctioned-structure grain, the silver iodide content may be higher in a host crystal than that in a junctioned crystal and vice versa. The boundary portion between different halogen compositions in a grain having any of the above structures may be either definite or indefinite. It is also possible to positively form a continuous composition change.

In a silver halide grain in which two or more silver halides are present as a mixed crystal or with a structure, it is important to control the distribution of halogen compositions between grains. A method of measuring the distribution of halogen compositions between grains is described in JP-A-60-254032. A uniform halogen distribution between grains is a desirable characteristic. In particular, a highly uniform emulsion having a variation coefficient of 20% or less is preferable. An emulsion having a correlation between a grain size and a halogen composition is also preferable. An example of the correlation is that larger grains have higher iodide contents and smaller grains have lower iodide contents. An opposite correlation or a correlation with respect to another halogen composition can also be selected in accordance with the intended use. For this purpose, it is preferable to mix two or more emulsions having different compositions.

It is important to control the halogen composition near the surface of a grain. Increasing the silver iodide content or the silver chloride content near the surface can be selected in accordance with the intended use because this changes a dye adsorbing property or a developing rate. In order to change the halogen composition near the surface, it is possible to select either the structure in which a grain is entirely surrounded by a silver halide or the structure in which a silver halide is adhered to only a portion of a grain. For example, a halogen composition of only one of a (100) face and a (111) face of a tetradecahedral grain may be changed, or a halogen composition of one of a major face or a side face of a tabular grain may be changed.

Silver halide grains for use in the present invention can be selected in accordance with the intended use. Examples are a regular crystal not containing a twin plane and crystals explained in Japan Photographic Society ed., The Basis of Photographic Engineering, Silver Salt Photography (CORONA PUBLISHING CO., LTD.), page 163, such as a single twinned crystal containing one twin plane, a parallel multiple twinned crystal containing two or more parallel twin planes, and a nonparallel multiple twinned crystal containing two or more nonparallel twin planes. A method of mixing grains having different shapes is disclosed in U.S. Pat. No. 4,865,964, and this method can be selected as needed. In the case of a regular crystal, it is possible to use a cubic grain constituted by (100) faces, an octahedral grain constituted by (111) faces, or a dodecahedral grain constituted by (110) faces disclosed in JP-B-55-42737 or JP-A-60-222842. It is also possible to use, in accordance with the intended use of an emulsion, an (h11) face grain represented by a (211) face grain, an (hh1) face grain represented by a (331) face grain, an (hk0) face grain represented by a (210) face grain, or an (hk1) face grain represented by a (321) face grain, as reported in Journal of Imaging Science, Vol. 30, page 247, 1986, although the preparation method requires some improvements. A grain having two or more different faces, such as a tetradecahedral grain having both (100) and (111) faces, a grain having (100) and (110) faces, or a grain having (111) and (110) faces can also be used in accordance with the intended use.

A value obtained by dividing the equivalent-circle diameter of the projected area of a grain by the thickness of that grain is called an aspect ratio that defines the shape of a tabular grain. Tabular grains having aspect ratios higher than 1 can be used in the present invention. Tabular grains can be prepared by the methods described in, e.g., Cleve, Photography Theory and Practice (1930), page 131; Gutoff, Photographic Science and Engineering, Vol. 14, pages 248 to 257, (1970); and U.S. Pat. Nos. 4,434,226, 4,414,310, 4,433,048, and 4,439,520, and British Patent 2,112,157. The use of tabular grains brings about advantages, such as an increase in covering power and an increase in color sensitization efficiency due to sensitizing dyes. These advantages are described in detail in U.S. Pat. No. 4,434,226 cited above. An average aspect ratio of 80% or more of a total projected area of grains is preferably 1 to less than 100, more preferably 2 to less than 20, and most preferably 3 to less than 10. The shape of a tabular grain can be selected from, e.g., a triangle, a hexagon, and a circle. An example of a preferable shape is a regular hexagon having six substantially equal sides, as described in U.S. Pat. No. 4,797,354.

An equivalent-circle diameter of a projected area is often used as the grain size of tabular grains. To improve the image quality, grains with an average diameter of 0.6 μm or smaller such as described in U.S. Pat. No. 4,748,106 are preferable. Also, defining the grain thickness as one dimension of tabular grains to 0.5 μm or less, more preferably 0.3 μm or less is preferable to improve the sharpness. Grains described in JP-A-63-163451 in which the grain thickness and the distance between twin planes are defined are also preferable.

More desirable results can sometimes be obtained when monodisperse tabular grains with a narrow grain size distribution are used. U.S. Pat. No. 4,797,354 and JP-A-2-838 describe methods of manufacturing monodisperse hexagonal tabular grains with a high degree of tabulation. EP 514,742 describes a method of manufacturing tabular grains whose variation coefficient of a grain size distribution is smaller than 10% by using a polyalkyleneoxide block copolymer. The use of these tabular grains in the present invention is preferable. Grains with a grain thickness variation coefficient of 30% or less, i.e., with a high thickness uniformity are also preferable.

Dislocation lines of a tabular grain can be observed by using a transmission electron microscope. It is preferable to select a grain containing no dislocations, a grain containing several dislocations, or a grain containing a large number of dislocations in accordance with the intended use. It is also possible to select dislocations introduced linearly with respect to a specific direction of a crystal orientation of a grain or dislocations curved with respect to that direction. Alternatively, it is possible to selectively introduce dislocations throughout an entire grain or only to a particular portion of a grain, e.g., the fringe portion of a grain. Introduction of dislocation lines is preferable not only for tabular grains but for a regular crystal grain or an irregular grain represented by a potato-like grain. In the case of these grains, as in the above case, it is preferable to limit the positions of dislocation lines to specific portions, such as the corners or the edges, of a grain.

A silver halide emulsion for use in the present invention may be subjected to a treatment for rounding grains, as disclosed in EP 96,727B1 or EP 64,412B1, or surface modification, as disclosed in West German Patent 2,306,447C2 or JP-A-60-221320.

Although a flat grain surface is common, intentionally forming projections and recesses on the surface is preferable in some cases. Examples are methods described in JP-A-58-106532 and JP-A-60-221320, in which a hole is formed in a portion of a crystal, e.g., the corner or the center of the face of a crystal, and a ruffle grain described in U.S. Pat. No. 4,643,966.

The grain size of an emulsion used in the present invention can be evaluated in terms of the equivalent-circle diameter of the projected area of a grain obtained by using an electron microscope, the equivalent-sphere diameter of the volume of a grain calculated from the projected area and the thickness of the grain, or the equivalent-sphere diameter of the volume of a grain obtained by a Coulter counter method. It is possible to selectively use various grains from an ultrafine grain having an equivalent-sphere diameter of 0.05 μm or less to a coarse grain having that of 10 μm or more. It is preferable to use a grain having an equivalent-sphere diameter of 0.1 to 3 μm as a light-sensitive silver halide grain.

In the present invention, it is possible to use a so-called polydisperse emulsion having a wide grain size distribution or a monodisperse emulsion having a narrow grain size distribution in accordance with the intended use. As a measure representing the size distribution, a variation coefficient of either the equivalent-circle diameter of the projected area of a grain or the equivalent-sphere diameter of the volume of a grain is sometimes used. when a monodisperse emulsion is to be used, it is desirable to use an emulsion having a size distribution with a variation coefficient of preferably 25% or less, more preferably 20% or less, and most preferably 15% or less.

The monodisperse emulsion is sometimes defined as an emulsion having a grain size distribution in which 80% or more of all grains fall within a range of ±30% of an average grain size represented by the number or the weight of grains. In order for a light-sensitive material to satisfy its target gradation, two or more monodisperse silver halide emulsions having different grain sizes can be mixed in the same emulsion layer or coated as different layers in an emulsion layer having essentially the same color sensitivity. It is also possible to mix, or coat as different layers, two or more types of polydisperse silver halide emulsions or monodisperse emulsions together with polydisperse emulsions.

Photographic emulsions used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964. That is, any of an acid method, a neutral method, and an ammonia method can be used. In forming grains by a reaction of a soluble silver salt and a soluble halogen salt, any of a single-jet method, a double-jet method, and a combination of these methods can be used. It is also possible to use a method (so-called reverse mixing) of forming grains in the presence of excess silver ion. As one type of the double-jet method, a method in which the pAg of a liquid phase for producing a silver halide is maintained constant, i.e., a so-called controlled double-jet method can be used. This method makes it possible to obtain a silver halide emulsion in which a crystal shape is regular and a grain size is nearly uniform.

In some cases, it is preferable to make use of a method of adding silver halide grains already formed by precipitation to a reactor vessel for emulsion preparation, and the methods described in U.S. Pat. Nos. 4,334,012, 4,301,241, and 4,150,994. These silver halide grains can be used as seed crystal and are also effective when supplied as a silver halide for growing. In the latter case, addition of an emulsion with a small grain size is preferable. The total amount of an emulsion can be added at one time, or an emulsion can be separately added a plurality of times or added continuously. In addition, it is sometimes effective to add grains having several different halogen compositions in order to modify the surface.

A method of converting most of or only a part of the halogen composition of a silver halide grain by a halogen conversion process is disclosed in, e.g., U.S. Pat. Nos. 3,477,852 and 4,142,900, EP 273,429 and EP 273,430, and West German Patent 3,819,241. This method is an effective grain formation method. To convert into a silver salt that is more sparingly soluble, it is possible to add a solution or silver halide grains of a soluble halogen. The conversion can be performed at one time, separately a plurality of times, or continuously.

As a grain growing method other than the method of adding a soluble silver salt and a halogen salt at a constant concentration and a constant flow rate, it is preferable to use a grain formation method in which the concentration or the flow rate is changed, such as described in British Patent 1,469,480 and U.S. Pat. Nos. 3,650,757 and 4,242,445. Increasing the concentration or the flow rate can change the amount of a silver halide to be supplied as a linear function, a quadratic function, or a more complex function of the addition time. It is also preferable to decrease the silver halide amount to be supplied if necessary depending on the situation. Furthermore, when a plurality of soluble silver salts of different solution compositions are to be added or a plurality of soluble halogen salts of different solution compositions are to be added, a method of increasing one of the salts while decreasing the other is also effective.

A mixing vessel for reacting solutions of soluble silver salts and soluble halogen salts can be selected from those described in U.S. Pat. Nos. 2,996,287, 3,342,605, 3,415,650, and 3,785,777 and West German Patents 2,556,885 and 2,555,364.

A silver halide solvent is useful for the purpose of accelerating ripening. As an example, it is known to make an excess of halogen ion exist in a reactor vessel in order to accelerate ripening. Another ripening agent can also be used. The total amount of these ripening agents can be mixed in a dispersing medium placed in a reactor vessel before addition of silver and a halide salt or can be introduced to the reactor vessel simultaneously with addition of a halide salt, a silver salt, and a deflocculant. Alternatively, ripening agents can be independently added in the step of adding a halide salt and a silver salt.

Examples of the ripening agent are ammonia, thiocyanate (e.g., potassium rhodanate and ammonium rhodanate), an organic thioether compound (e.g., compounds described in U.S. Pat. Nos. 3,574,628, 3,021,215, 3,057,724, 3,038,805, 4,276,374, 4,297,439, 3,704,130, and 4,782,013 and JP-A-57-104926), a thione compound (e.g., 4-substituted thioureas described in JP-A-53-82408, JP-A-55-77737, and U.S. Pat. No. 4,221,863, and compounds described in JP-A-53-144319), mercapto compounds capable of accelerating growth of silver halide grains, described in JP-A-57-202531, and an amine compound (e.g., JP-A-54-100717).

It is advantageous to use gelatin as a protective colloid for use in preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a sugar derivative, such as hydroxyethylcellulose, carboxymethylcellulose, a cellulose derivative such as cellulose sulfates, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, acid-processed gelatin, and enzyme-processed gelatin described in Bull. Soc. Sci. Photo. Japan. No. 16, page 30 (1966). In addition, a hydrolyzed product or an enzyme-decomposed product of gelatin can also be used.

It is preferable to wash an emulsion of the present invention to form a newly prepared protective colloid dispersion for a desairing purpose. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desairing, or chemical sensitization, or before coating in accordance with the intended use. The metal ion salt is preferably added during grain formation in performing doping for grains, and after grain formation and before completion of chemical sensitization in decorating the grain surface or when used as a chemical sensitizer. The doping can be performed for any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in a combination of two or more types of them.

The metal compounds are preferably dissolved in an appropriate solvent, such as methanol or acetone, and added in the form of a solution. To stabilize the solution, an aqueous halogenated hydrogen solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be made present.

In formation of silver halide grains of the present invention, at least one of sulfur sensitization, selenium sensitization, gold sensitization, palladium sensitization or noble metal sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization speck is embedded inside a grain, a type in which it is embedded at a shallow position from the surface of a grain, and a type in which it is formed on the surface of a grain. In emulsions of the present invention, the location of a chemical sensitization speck can be selected in accordance with the intended use. It is, however, generally preferable to form at least one type of a chemical sensitization speck near the surface.

One chemical sensitization which can be preferably performed in the present invention is chalcogen sensitization, noble metal sensitization, or a combination of these. The sensitization can be performed by using an active gelation as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° to 0° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimldine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, "Photographic Emulsion Chemistry," pages 138 to 143.

It is preferable to also perform gold sensitization for emulsions of the present invention. An amount of a gold sensitizer is preferably $1\times10^{-4}$ to $1\times10^{-7}$ mol per mol of silver halide, and more preferably $1\times10^{-5}$ to $5\times10^{-7}$ mol per mol of silver halide. A preferable amount of a palladium compound is $1\times10^{-3}$ to $5\times10^{-7}$ mole per mol of silver halide. A preferable amount of a thiocyan compound or a selenocyan compound is $5\times10^{-2}$ to $1\times10^{-6}$ mol per mol of silver halide.

An amount of a sulfur sensitizer with respect to silver halide grains of the present invention is preferably $1\times10^{-4}$ to $1\times10^{-7}$ mol, and more preferably $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

Photographic emulsions to be used in the present invention may contain various compounds in order to prevent fog during the manufacturing process, storage, or photographic treatments of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in Japanese Patent Application 62-47225. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. Nos. 4,663,271, 4,705,744, 4,707,436, JP-A-62-160448, and JP-A-63-89850.

As described above, various layer configurations and arrangements can be selected in accordance with the application of the light-sensitive material.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left–right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD No. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The silver halide color light-sensitive material of the present invention exerts its advantages more effectively when applied to a film unit equipped with a lens disclosed in JP-B-2-32615 or Examined Published Japanese Utility Model Application (JU-B) 3-39782.

The present invention will be described in more detail below by way of its examples, but the invention is not limited to these examples.

EXAMPLE 1

(Preparation of emulsions)

(i) 1000 ml of an aqueous solution containing 4.8 g of gelatin and 3.0 g of potassium bromide was stirred at 60° C. (ii) An aqueous silver nitrate solution (8.2 g of $AgNO_3$) and an aqueous halides solution (5.7 g of KBr and 0.21 g of KI) were added by double-jet over 1 minute. (iii) After 21.5 g of gelatin were added, the temperature was raised to 75° C. (iv) An aqueous silver nitrate solution (136.3 g of $AgNO_3$) and an aqueous halides solution (containing 2.6 mol % of KI with respect to KBr) were added by double-jet at accelerated flow rates over 51 minutes. During the addition, the silver potential was held at 0 mV with respect to the saturated calomel electrode. (v) The temperature was decreased to 40° C., and an aqueous silver nitrate solution (3.2 g of $AgNO_3$) and an aqueous KI solution (3.2 g of KI) were added over 5 minutes. Thereafter, (vi) an aqueous silver nitrate solution (25.4 g of $AgNO_3$) and an aqueous KBr solution (20.8 g of KBr) were added by double-jet over 5 minutes and 20 seconds. During the addition, the silver potential was kept at −50 mV with respect to the saturated calomel electrode. (vii) The resultant emulsion was desalted by a flocculation method, and added with gelatin. Thereafter, the pH and the pAg were adjusted to 5.5 and 8.8, respectively, and chemical sensitization was optimally performed by using potassium thiocyanate, chloroauric acid, sodium thiosulfate, and dimethylselenourea. The resultant emulsion E1 consisting of triple-structure silver bromoiodide grains was found to have an average equivalent-sphere diameter of 0.63 μm and a variation coefficient of grain size distribution of 24%. Tabular grains with an aspect ratio of 2 or more occupied 80% of the total projected area, and the average aspect ratio of these tabular grains was 5.0. The total silver iodide content was 4.1 mol %.

Emulsions A1, B1, C1, D1, F1, G1, H1, and I1 were prepared, respectively, by adjusting the gelatin quantity, silver potential, temperature, and KI content in the grain formation of the emulsion E1.

An emulsion E2 was prepared by performing reduction sensitization by adding $4.1\times10^{-5}$ mol of L-ascorbic acid per mol of silver, as a reduction sensitizer, immediately before the step (iv) in the preparation of the emulsion E1. Likewise, emulsions A2, B2, C2, D2, F2, G2, H2, and I2 were prepared by changing the preparation steps of the emulsions A1, B1, C1, D1, F1, G1, H1, and I1, respectively, in the same manner as for the emulsion E2.

An emulsion E3 was prepared following the same procedures as for the emulsion E2 except that $6.5\times10^{-6}$ mol of thiourea dioxide per mol of silver was used as a reduction sensitizer, in place of L-ascorbic acid, in the preparation of the emulsion E2. Emulsions A3, B3, C3, D3, F3, G3, H3, and I3 were prepared by similarly changing the preparation steps of the emulsions A2, B2, C2, D2, F2, G2, H2, and I2, respectively.

An emulsion E4 was prepared following the same procedures as for the emulsion E2 except that an exemplified compound II-21 described in this specification was added in an amount of $1.2\times10^{-5}$ mol per mol of silver immediately before the step (iv) and before the addition of L-ascorbic acid in the preparation of the emulsion E2. By similarly changing the preparation steps of the emulsions A2, B2, C2, D2, F2, G2, H2, and I2, emulsions A4, B4, C4, D4, F4, G4, H4, and I4, respectively, were prepared.

An emulsion E5 was prepared following the same procedures as for the emulsion E3 except that an example compound II-2 described in this specification was added in an amount of $4.2\times10^{-6}$ mol per mol of silver immediately after the step (iv) in the preparation of the emulsion E3. Emulsions A5, B5, C5, D5, F5, G5, H5, and I5 were prepared by changing the preparation steps of the emulsions A3, B3, C3, D3, F3, G3, H3, and I3, respectively, in the same manner.

EXAMPLE 2

(Preparation of silver halide multilayered color light-sensitive material)

On an undercoated cellulose triacetate film support, a sample 101, silver halide multilayered color light-sensitive material, consisting of layers having the compositions presented below was formed. (Compositions of light-sensitive layers)

The coating amount of each of a silver halide and colloidal silver is represented by a silver amount in units of g/m$^2$, and that of each of a coupler, an additive, and gelatin is represented in units of g/m$^2$. The coating amount of a sensitizing dye is represented by the number of mols per mol of the silver halide in the same layer. Symbols representing additives have the following meanings. Note that an additive having a plurality of effects is represented by one of them.

Uv; ultraviolet absorbent, Solv; high-boiling organic solvent, ExF; dye, ExS; sensitizing dye, ExC; cyan coupler, ExM; magenta coupler, ExY; yellow coupler, Cpd; additive.

| | |
|---|---|
| 1st layer (antihalation layer) | |
| Black colloidal silver | 0.15 |
| Gelatin | 2.33 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-2}$ |
| ExF-2 | $4.0 \times 10^{-2}$ |
| ExF-3 | $5.0 \times 10^{-3}$ |
| ExM-3 | 0.11 |
| Cpd-5 | $1.0 \times 10^{-3}$ |
| Solv-1 | 0.16 |
| Solv-2 | 0.10 |
| 2nd layer (low-speed red-sensitive emulsion layer) | |
| Silver bromoiodide emulsion A1 coating amount in terms of silver | 0.35 |
| Silver bromoiodide emulsion B1 coating amount in terms of silver | 0.18 |
| Gelatin | 0.77 |
| ExS-1 | $4.1 \times 10^{-4}$ |
| ExS-2 | $2.4 \times 10^{-4}$ |
| ExS-5 | $3.9 \times 10^{-4}$ |
| ExS-7 | $6.9 \times 10^{-6}$ |
| ExC-1 | $9.0 \times 10^{-2}$ |
| ExC-2 | $5.0 \times 10^{-3}$ |
| ExC-3 | $4.0 \times 10^{-2}$ |
| ExC-5 | $8.0 \times 10^{-2}$ |
| ExC-6 | $2.0 \times 10^{-2}$ |
| ExC-9 | $2.5 \times 10^{-2}$ |
| Cpd-4 | $2.2 \times 10^{-3}$ |
| 3rd layer (medium-speed red-sensitive emulsion layer) | |
| Silver bromoiodide emulsion C1 coating amount in terms of silver | 0.55 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $1.0 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $2.5 \times 10^{-2}$ |
| ExC-9 | $3.0 \times 10^{-2}$ |
| Cpd-4 | $1.5 \times 10^{-3}$ |
| 4th layer (high-speed red-sensitive emulsion layer) | |
| Silver bromoiodide emulsion D1 coating amount in terms of silver | 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $2.0 \times 10^{-2}$ |

-continued

| | |
|---|---|
| ExC-3 | $2.0 \times 10^{-2}$ |
| ExC-4 | $9.0 \times 10^{-2}$ |
| ExC-5 | $5.0 \times 10^{-2}$ |
| ExC-8 | $1.0 \times 10^{-2}$ |
| ExC-9 | $1.0 \times 10^{-2}$ |
| Cpd-4 | $1.0 \times 10^{-3}$ |
| Solv-1 | 0.70 |
| Solv-2 | 0.15 |
| 5th layer (interlayer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| 6th layer (low-speed green-sensitive emulsion layer) | |
| Silver bromoiodide emulsion A1 coating amount in terms of silver | 0.25 |
| Silver bromoiodide emulsion B1 coating amount in terms of silver | 0.13 |
| Gelatin | 0.31 |
| ExS-8 | $5.8 \times 10^{-5}$ |
| ExS-4 | $9.0 \times 10^{-4}$ |
| ExS-5 | $1.8 \times 10^{-4}$ |
| ExM-1 | 0.12 |
| ExM-7 | $2.1 \times 10^{-2}$ |
| Solv-1 | 0.09 |
| Solv-3 | $7.0 \times 10^{-3}$ |
| 7th layer (medium-speed green-sensitive emulsion layer) | |
| Silver bromoiodide emulsion C1 coating amount in terms of silver | 0.37 |
| Gelatin | 0.54 |
| ExS-8 | $3.5 \times 10^{-5}$ |
| ExS-4 | $5.4 \times 10^{-4}$ |
| ExS-5 | $1.1 \times 10^{-4}$ |
| ExM-1 | 0.27 |
| ExM-7 | $7.2 \times 10^{-2}$ |
| ExY-1 | $5.4 \times 10^{-2}$ |
| Solv-1 | 0.23 |
| Solv-3 | $1.8 \times 10^{-2}$ |
| 8th layer (high-speed green-sensitive emulsion layer) | |
| Silver bromoiodide emulsion D1 coating amount in terms of silver | 0.53 |
| Gelatin | 0.61 |
| ExS-4 | $4.3 \times 10^{-4}$ |
| ExS-5 | $8.6 \times 10^{-6}$ |
| ExS-8 | $2.8 \times 10^{-5}$ |
| ExM-2 | $5.5 \times 10^{-3}$ |
| ExM-3 | $1.0 \times 10^{-2}$ |
| ExM-5 | $1.0 \times 10^{-2}$ |
| ExM-6 | $3.0 \times 10^{-2}$ |
| ExY-1 | $1.0 \times 10^{-2}$ |
| ExC-1 | $4.0 \times 10^{-3}$ |
| ExC-4 | $2.5 \times 10^{-3}$ |
| Cpd-6 | $1.0 \times 10^{-2}$ |
| Solv-1 | 0.12 |
| 9th layer (interlayer) | |
| Gelatin | 0.56 |
| UV-4 | $4.0 \times 10^{-2}$ |
| UV-5 | $3.0 \times 10^{-2}$ |
| Cpd-1 | $4.0 \times 10^{-2}$ |
| Polyethylacrylate latex | $5.0 \times 10^{-2}$ |
| Solv-1 | $3.0 \times 10^{-2}$ |
| 10th layer (donor layer having interimage effect on red-sensitive layer) | |
| Silver bromoiodide emulsion E1 coating amount in terms of silver | 0.53 |
| Silver bromoiodide emulsion F1 coating amount in terms of silver | 0.46 |
| Gelatin | 0.87 |
| ExS-3 | $8.7 \times 10^{-4}$ |
| ExM-2 | 0.16 |
| ExM-4 | $3.0 \times 10^{-2}$ |
| ExM-5 | $5.0 \times 10^{-2}$ |

| | |
|---|---|
| ExY-2 | $2.5 \times 10^{-3}$ |
| ExY-5 | $2.0 \times 10^{-2}$ |
| Solv-1 | 0.30 |
| Solv-5 | $3.0 \times 10^{-2}$ |
| 11th layer (yellow filter layer) | |
| Yellow colloidal silver | $9.0 \times 10^{-2}$ |
| Gelatin | 0.84 |
| Cpd-1 | $5.0 \times 10^{-2}$ |
| Cpd-2 | $5.0 \times 10^{-2}$ |
| Cpd-5 | $2.0 \times 10^{-3}$ |
| Solv-1 | 0.13 |
| H-1 | 0.25 |
| 12th layer (low-speed blue-sensitive emulsion layer) | |
| Silver bromoiodide emulsion G1 coating amount in terms of silver | 0.58 |
| Silver bromoiodide emulsion H1 coating amount in terms of silver | 0.32 |
| Gelatin | 1.75 |
| ExS-6 | $5.9 \times 10^{-4}$ |
| ExS-9 | $4.7 \times 10^{-4}$ |
| ExY-1 | $8.5 \times 10^{-2}$ |
| ExY-2 | $5.5 \times 10^{-3}$ |
| ExY-3 | $6.0 \times 10^{-2}$ |
| ExY-5 | 1.00 |
| ExC-1 | $5.0 \times 10^{-2}$ |
| ExC-2 | $8.0 \times 10^{-2}$ |
| Solv-1 | 0.54 |
| 13th layer (interlayer) | |
| Gelatin | 0.30 |
| ExY-4 | 0.14 |
| Solv-1 | 0.14 |
| 14th layer (high-speed blue-sensitive emulsion layer) | |
| Silver bromoiodide emulsion I1 coating amount in terms of silver | 0.40 |
| Gelatin | 0.95 |
| ExS-6 | $3.1 \times 10^{-4}$ |
| ExS-9 | $2.5 \times 10^{-4}$ |
| ExY-2 | $1.0 \times 10^{-2}$ |

| | |
|---|---|
| ExY-3 | $2.0 \times 10^{-2}$ |
| ExY-5 | 0.18 |
| ExC-1 | $1.0 \times 10^{-2}$ |
| Solv-1 | $9.0 \times 10^{-2}$ |
| 15th layer (1st protective layer) | |
| Fine grain silver bromoiodide emulsion J coating amount in terms of silver | 0.12 |
| Gelatin | 0.63 |
| UV-4 | 0.11 |
| UV-5 | 0.18 |
| Cpd-3 | 0.10 |
| Solv-5 | $2.0 \times 10^{-2}$ |
| Polyethylacrylate latex | $9.0 \times 10^{-2}$ |
| 16th layer (2nd protective layer) | |
| Fine grain silver bromoiodide emulsion J coating amount in terms of silver | 0.36 |
| Gelatin | 0.85 |
| B-1 (diameter 2.0 μm) | $8.0 \times 10^{-2}$ |
| B-2 (diameter 2.0 μm) | $8.0 \times 10^{-2}$ |
| B-3 | $2.0 \times 10^{-2}$ |
| W-5 | $2.0 \times 10^{-2}$ |
| H-1 | 0.18 |

In addition to the above components, the sample thus manufactured was added with 1,2-benzisothiazoline-3-one (200 ppm on average with respect to gelatin), n-butyl-p-hydroxybenzoate (about 1,000 ppm on average with respect to gelatin), and 2-phenoxyethanol (about 10,000 ppm on average with respect to gelatin). In order to improve the storage stability, processability, resistance to pressure, antiseptic and mildewproofing properties, antistatic properties, and coating properties, the individual layers were further made contain W-1 to W-6, B-1 to B-6, F-1 to F-16, iron salt, lead salt, gold salt, platinum salt, iridium salt, and rhodium salt.

TABLE 1

| | Average AgI content (mol %) | Grain size (equivalent-sphere diameter in average) (μm) | Variation coefficient of grain size distribution (%) | Diameter/ thickness ratio | Structure and shape of grain |
|---|---|---|---|---|---|
| Emulsion | | | | | |
| A1 | 3.7 | 0.28 | 25 | 3.8 | Triple-structure tabular grain |
| B1 | 3.7 | 0.36 | 23 | 4.2 | Triple-structure tabular grain |
| C1 | 6.8 | 0.55 | 20 | 5.2 | Triple-structure tabular grain |
| D1 | 8.8 | 0.69 | 25 | 5.9 | Triple-structure tabular grain |
| E1 | 4.1 | 0.63 | 24 | 5.0 | Triple-structure tabular grain |
| F1 | 3.8 | 0.41 | 27 | 4.3 | Triple-structure tabular grain |
| G1 | 5.0 | 0.35 | 23 | 4.0 | Triple-structure tabular grain |
| H1 | 8.5 | 0.61 | 19 | 5.5 | Triple-structure tabular grain |
| I1 | 9.0 | 0.76 | 27 | 6.4 | Triple-structure tabular grain |
| J | 2.0 | 0.07 | 15 | 1.0 | Uniform-structure fine grain |

UV-1
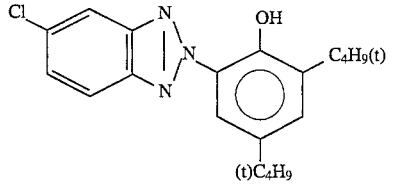
UV-2
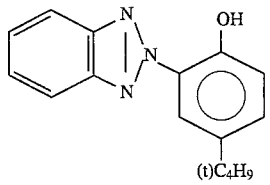
UV-3
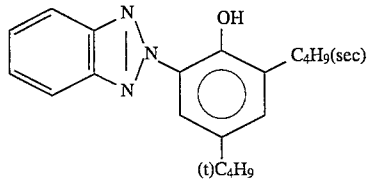
UV-4
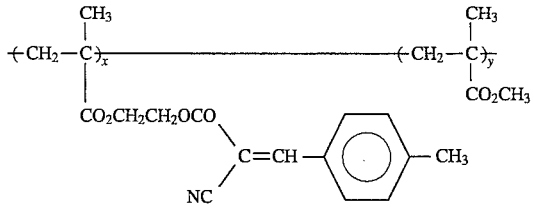
x:y = 70:30 (wt %)
UV-5
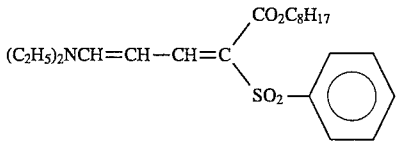
ExF-1
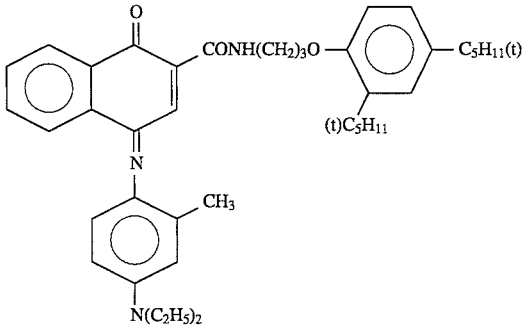
ExF-2
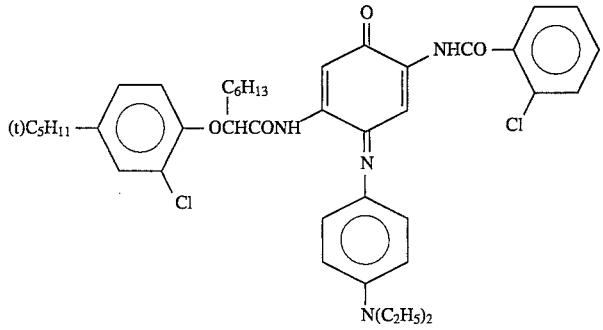

-continued
ExF-3
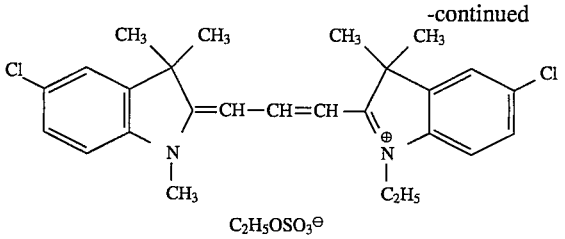
ExC-1
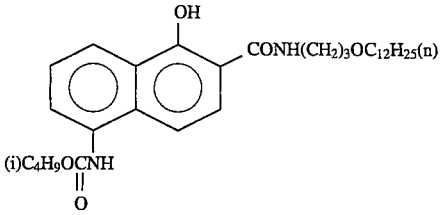
ExC-2
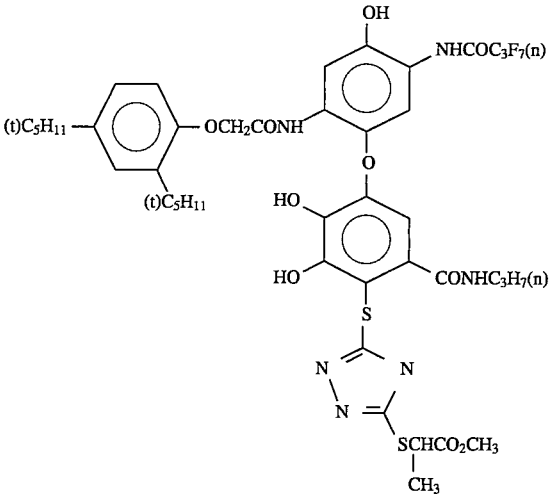
ExC-3
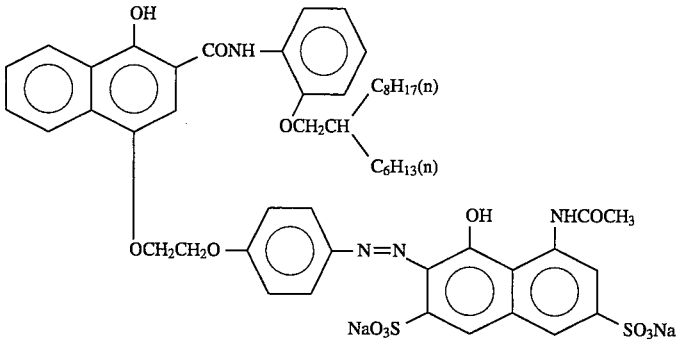
ExC-4
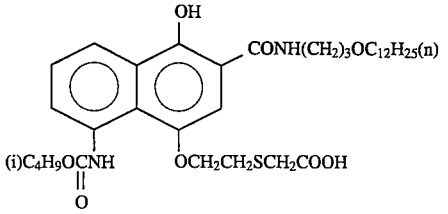

-continued
ExC-5
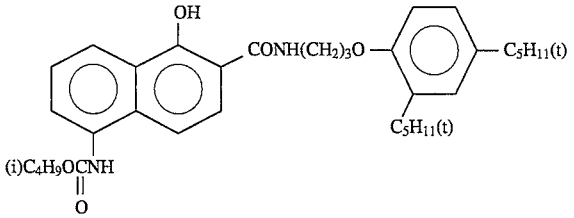
ExC-6
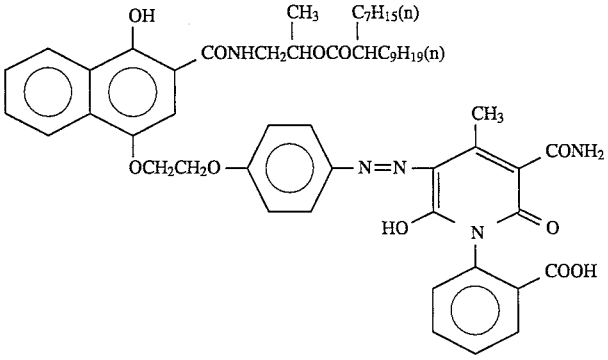
ExC-7
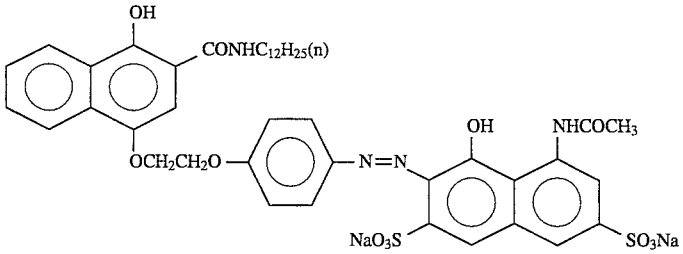
ExC-8
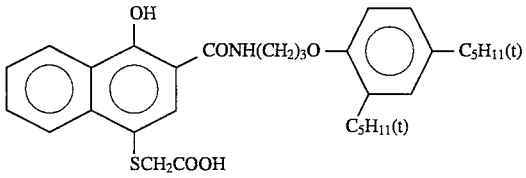
ExC-9
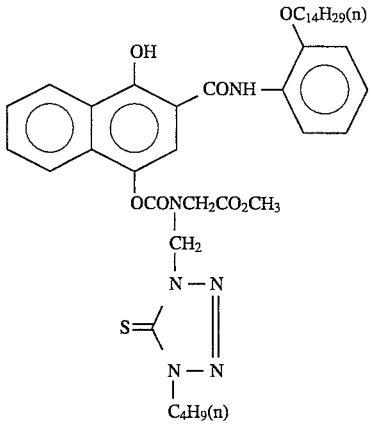

-continued
ExM-1
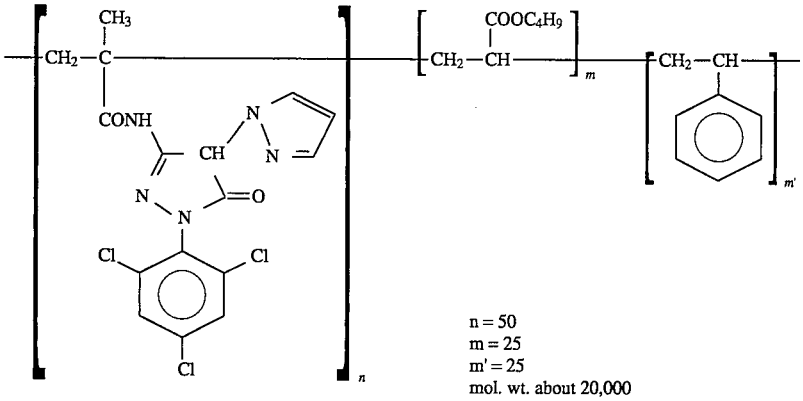
n = 50
m = 25
m' = 25
mol. wt. about 20,000
ExM-2
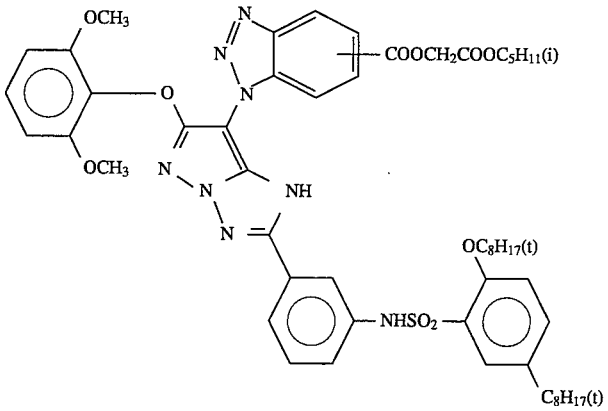
ExM-3
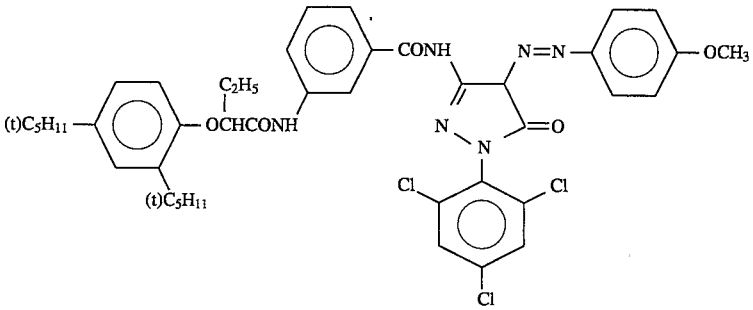
ExM-4
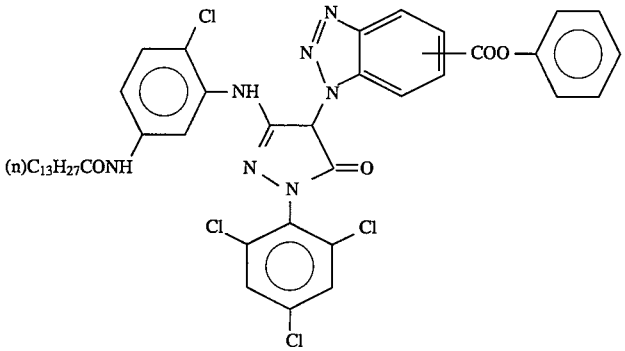

-continued
ExM-5
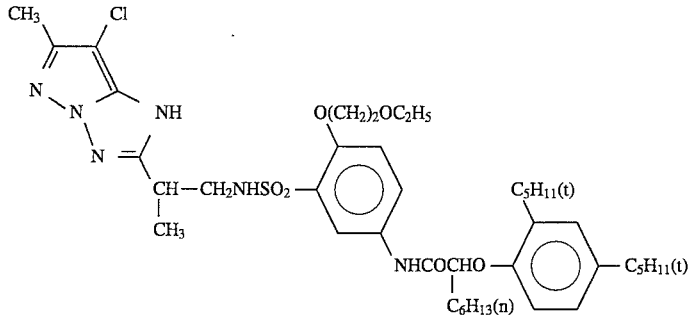
ExM-6
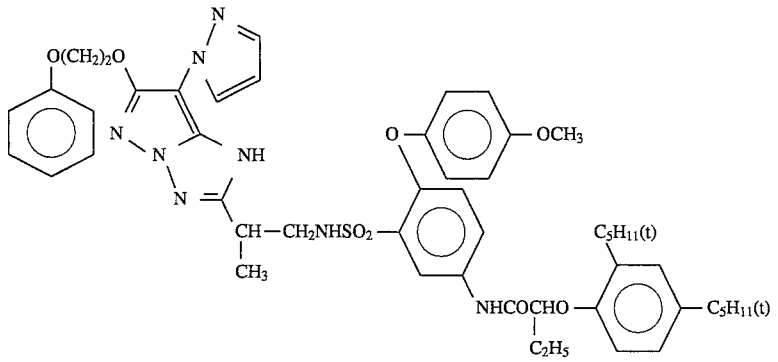
ExM-7
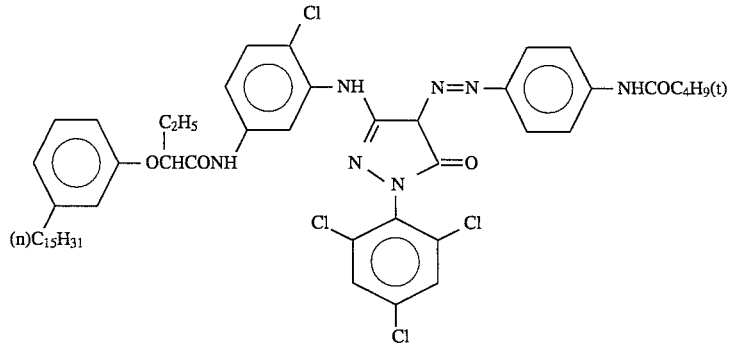
ExY-1
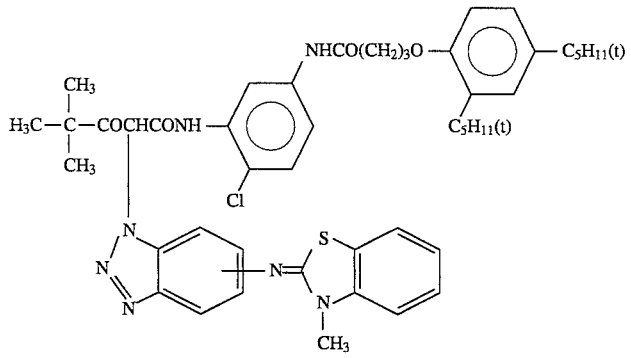
ExY-2
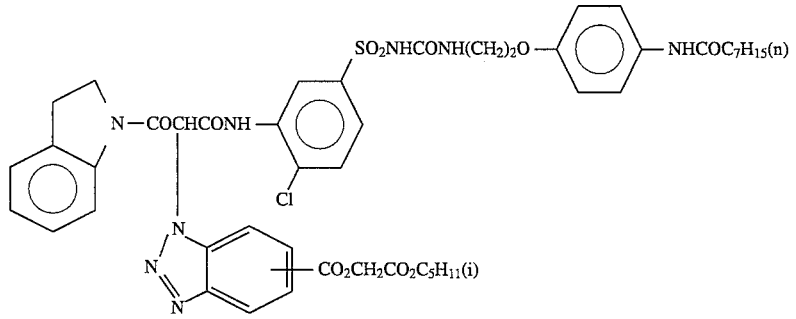

-continued
ExY-3
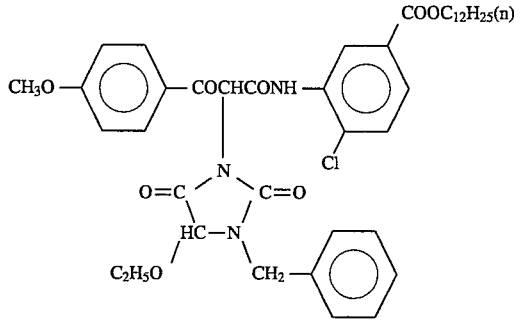
ExY-4
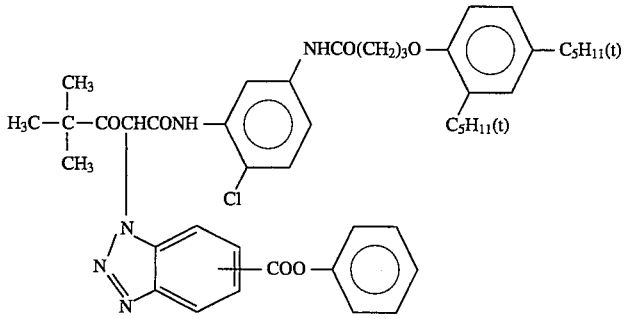
ExY-5
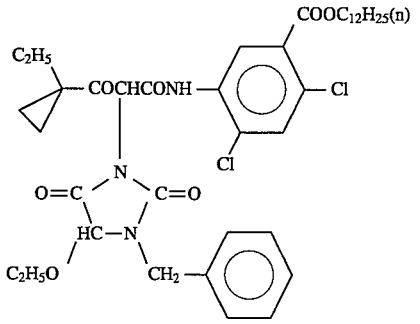
Cpd-1
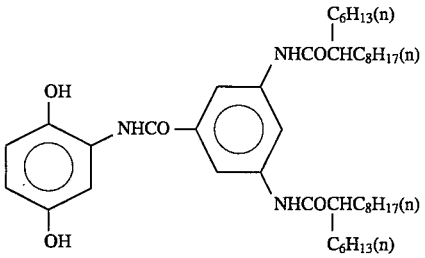
Cpd-2
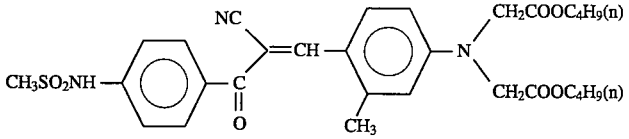
Cpd-3
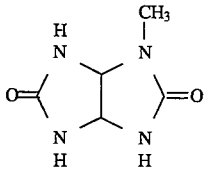

-continued
Cpd-4
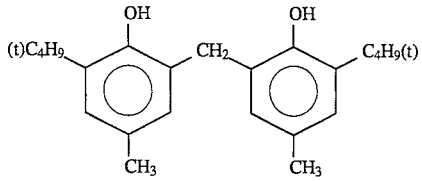
Cpd-5
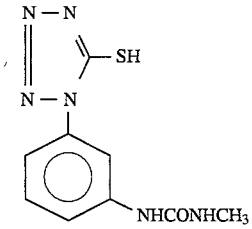
Cpd-6
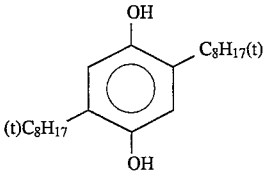
Solv-1
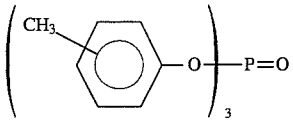
Solv-2
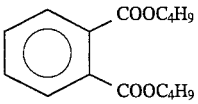
Solv-3
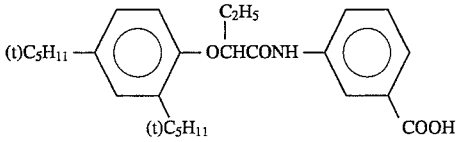
Solv-4
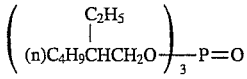
Solv-5
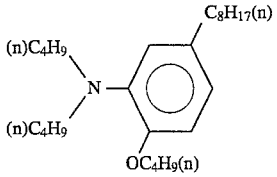
ExS-1
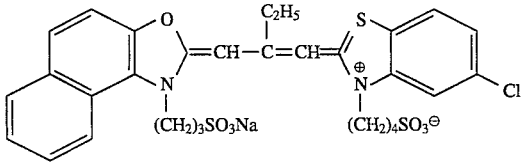
ExS-2
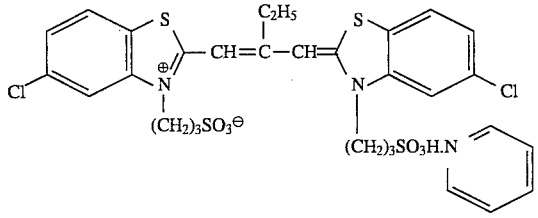

-continued
ExS-3
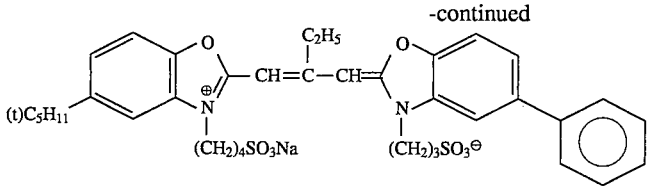
ExS-4
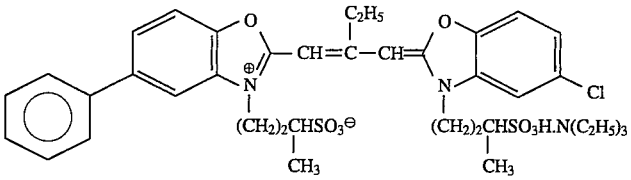
ExS-5
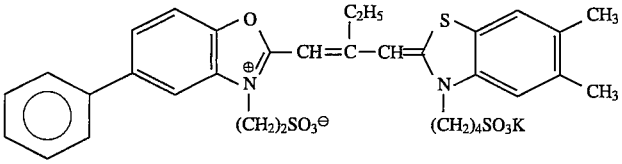
ExS-6
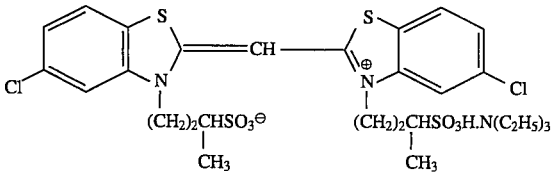
ExS-7
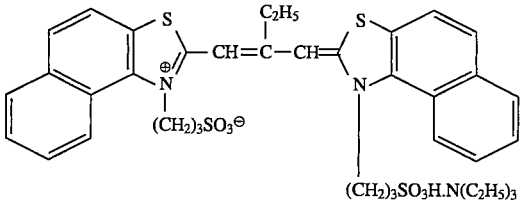
ExS-8
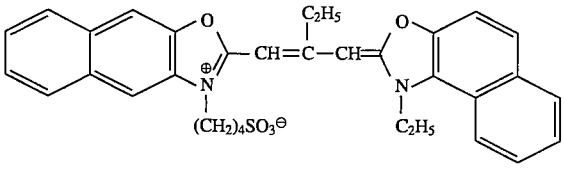
ExS-9
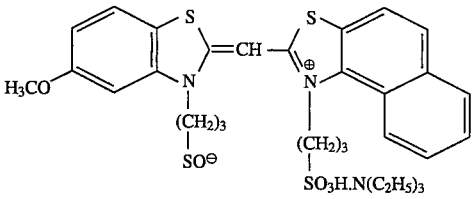
H-1
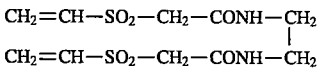
W-1
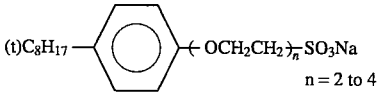
n = 2 to 4
W-2
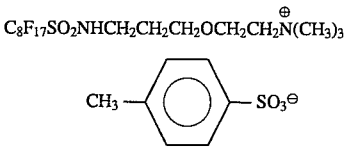

-continued
W-3
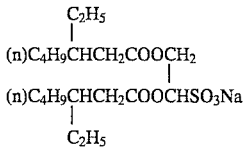
W-4
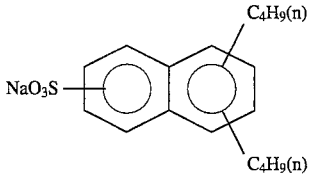
W-5
$C_8F_{17}SO_2N(C_3H_7)CH_2COOK$
W-6
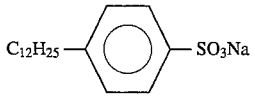
B-1
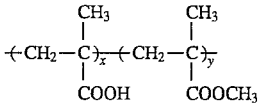
x/y = 10/90
B-2
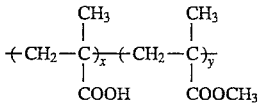
x/y = 40/60
B-3
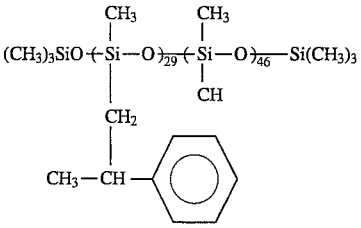
B-4
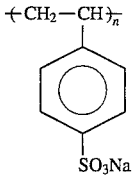
B-5
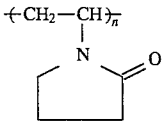
(mol. wt. about 10,000)
B-6
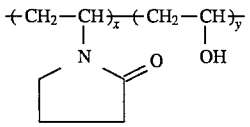
x/y = 70/30
F-1
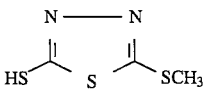

-continued
F-2
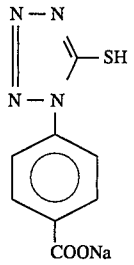
F-3
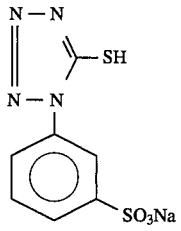
F-4
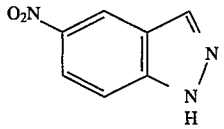
F-5
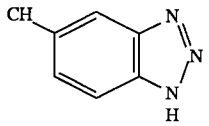
F-6
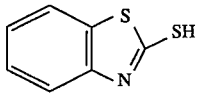
F-7
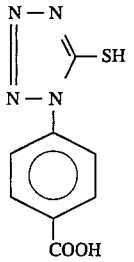
F-8
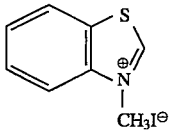
F-9
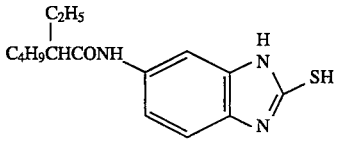
F-10
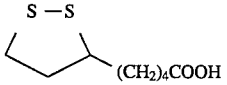
F-11
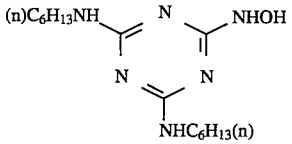

-continued

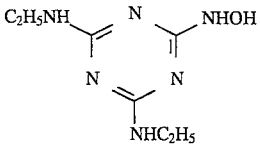

F-12

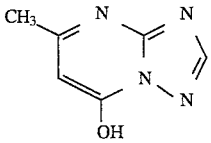

F-13

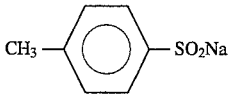

F-14

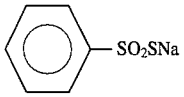

F-15

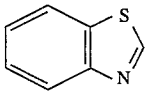

F-16

Samples 102 to 116 were prepared by changing the emulsions E1 and F1 and/or the sensitizing dye ExS-3 in the 10th layer of the sample 101 as shown in Table 2.

The samples 101 to 116 thus obtained were subjected to wedge exposure with white light at a color temperature of 4800K and to color development to be described later. Thereafter, the sensitivity of each resultant sample was evaluated by performing density measurement in accordance with a conventional method. The sensitivity is represented by a relative value of the reciprocal of an exposure by which a magenta density of fog+1.2 is given.

The storage stability of the light-sensitive materials formed was evaluated as follows. That is, one piece of a sample immediately after the preparation was stored in a freezer at −8° C. for 5 days, and another piece of the same sample was stored at 50° C. and a relative humidity (RH) of 80% for 5 days. Thereafter, wedge exposure and development were performed in the same manner as discussed above, and the sensitivities of the two sample pieces were compared. The evaluation was done assuming that a smaller increase or decrease in the sensitivity of the sample stored in the 50° C., 80% RH environment for 5 days with respect to the sensitivity of the sample stored in a freezer at −8° C. was an indication of a better storage stability.

variations in photographic properties with the passage of time from photography to development were evaluated as follows. After wedge exposure was done as described above, one sample piece was immediately developed, and another sample piece was stored at 25° C., 60% RH environment for 15 days and then developed. The resultant sensitivities of the two sample pieces were compared. A smaller increase or decrease in the sensitivity of the sample stored at 25° C., 60% RH for 15 days with respect to the sensitivity of the sample developed immediately after the exposure is preferable, since this indicates smaller variations in photographic properties with the passing of time from photography to development.

The evaluation results are summarized in Table 2 below.

TABLE 2

| Sample No. | Amounts of sensitizing dyes used in 10th layer per mol of silver halide *1 | Emulsion in 10th layer: Emulsion No. | Emulsion in 10th layer: Reduction sensitizer | Emulsion in 10th layer: Compound represented by Formula (II), (III) or (IV) added *2 | sensitivity | Ratio of increase or decrease in sensitivity after storage at 50° C., 80% RH for 5 days (%) | Ratio of increase or decrease in sensitivity after storage at 25° C., 60% RH for 15 days after exposure (%) |
|---|---|---|---|---|---|---|---|
| 101 (Comparative Example) | ExS-3 ($8.7 \times 10^{-4}$ mol) | E1, F1 | None | None | 100 | −43 | +15 |
| 102 (Comparative Example) | | E2, F2 | L-ascorbic acid | " | 112 | −47 | +21 |
| 103 (Comparative Example) | | E3, F3 | Thiourea dioxide | " | 114 | −45 | +19 |
| 104 (Comparative Example) | | E4, F4 | L-ascorbic acid | II-21 | 112 | −47 | +17 |

TABLE 2-continued

| Sample No. | Amounts of sensitizing dyes used in 10th layer per mol of silver halide *1 | Emulsion in 10th layer: Emulsion No. | Reduction sensitizer | Compound represented by Formula (II), (III) or (IV) added *2 | sensitivity | Ratio of increase or decrease in sensitivity after storage at 50° C., 80% RH for 5 days (%) | Ratio of increase or decrease in sensitivity after storage at 25° C., 60% RH for 15 days after exposure (%) |
|---|---|---|---|---|---|---|---|
| 105 (Comparative Example) | | E5, F5 | Thiourea dioxide | II-2 | 114 | −47 | +17 |
| 106 (Comparative Example) | I-3 ($5.8 \times 10^{-4}$ mol) and | E1, F1 | None | None | 98 | −15 | −40 |
| 107 (Present Invention) | I-27 ($5.8 \times 10^{-4}$ mol) | E2, F2 | L-ascorbic acid | " | 136 | −11 | −12 |
| 108 (Present Invention) | | E3, F3 | Thiourea dioxide | " | 138 | −9 | −12 |
| 109 (Present Invention) | | E4, F4 | L-ascorbic acid | II-21 | 138 | −6 | −7 |
| 110 (Present Invention) | | E5, F5 | Thiourea dioxide | II-2 | 140 | −4 | −7 |
| 111 (Comparative Example) | I-3 ($5.8 \times 10^{-4}$ mol), I-27 | E1, F1 | None | None | 143 | −15 | −38 |
| 112 (Present Invention) | ($5.8 \times 10^{-4}$ mol), and V-14 | E3, F3 | Thiourea dioxide | " | 180 | −9 | −9 |
| 113 (Present Invention) | ($2.5 \times 10^{-5}$ mol) | E5, F5 | Thiourea dioxide | II-21 | 182 | −4 | −6 |
| 114 (Comparative Example) | I-3 ($5.8 \times 10^{-4}$ mol), I-27 | E1, F1 | None | None | 145 | −19 | −32 |
| 115 (Present Invention) | ($5.8 \times 10^{-4}$ mol), and VI-3 | E3, F3 | Thiourea dioxide | " | 178 | −13 | −7 |
| 116 (Present Invention) | ($2.9 \times 10^{-4}$ mol) | E5, F5 | Thiourea dioxide | II-2 | 180 | −4 | −4 |

Note:
*1 I-3 and I-27 are the exemplified compounds represented by Formula (I) described in the specification.
V-14 and VI-3 are the exemplified compounds represented by Formula (V) and (VI), respectively, described in the specification.
*2 II-2 and II-21 are the exemplified compounds represented by Formula (II) described in the specification.

This example shows the effect of the present invention when the sensitizing dye in the donor layer which was spectrally sensitized by an oxacarbocyanine dye and had the interimage effect on the red-sensitive layers was replaced with a 2-quinocyanine dye represented by Formula (I). As can be seen from Table 2, when the sensitizing dye in the 10th layer of the sample 101 was merely changed from an oxacarbocyanine dye, ExS-3, to the exemplified 2-quinocyanine dye, a compound I-3 or 1-27, represented by Formula (I) of the present invention, the storage stability of the light-sensitive material under high-temperature, high-humidity conditions was greatly improved, but the sensitivity decreased significantly with the passage of time from exposure to development. However, when a compound represented by Formula (I) was used as the sensitizing dye in the 10th layer and at the same time emulsions subjected to reduction sensitization were used in that emulsion layer in accordance with the aspect of the present invention, it was possible to obtain a sample in which the sensitivity decreased little with the passing of time from exposure to development. In addition, this sample was improved in the storage stability under high-temperature, high-humidity conditions compared to samples in which emulsions not subjected to reduction sensitization were used in the 10th layer.

When the sensitizing dye in the 10th layer was an oxacarbocyanine dye, no favorable results were obtained for storage stability and for variations in photographic properties with the passage of time from photography to development even if the reduction-sensitized emulsions were used in that emulsion layer. Also, the advantage of increasing the sensitivity resulting from the use of the reduction-sensitized emulsion was larger when a 2-quinocyanine dye represented by Formula (I) was used than when an oxacarbocyanine dye was used, indicating the characteristic feature of the present invention.

It is also evident from Table 2 that more preferable results were obtained for storage stability and for variations in photographic properties with the passage of time from exposure to development by the use of an emulsion added with a thiosulfonate compound represented by Formula (II), (III), or (IV) in the manufacturing process of the reduction-sensitized emulsion for use in the 10th layer.

Furthermore, it is apparent from Table 2 that the advantage of raising the sensitivity was obtained when a compound represented by Formula (V) or (VI) was used in addition to a compound represented by Formula (I) as the sensitizing dye for use in the 10th layer. In this case, the advantage derived from the use of the reduction-sensitized emulsions in that emulsion layer was similar to that when only a compound represented by Formula (I) was used as the sensitizing dye.

EXAMPLE 3

Samples 201 to 209 were prepared by replacing the emulsions G1 and H1 in the 12th layer and the emulsion I1 in the 14th layer, and/or the sensitizing dyes in the 12th and 14th layers of the sample 101 of Example 2 as shown in Table 3 below.

The resultant samples 101 and 201 to 209 were evaluated following the same procedures as in Example 2. The sensitivity is represented by a relative value of the reciprocal of an exposure by which the yellow density of fog+0.4 is given.

The evaluation results were summarized in Table 3 below.

decreased with the passage of time from exposure to development. Samples in which emulsions subjected to reduction sensitization in accordance with the aspect of the present invention were used in those emulsion layers are preferable, since a decrease in the sensitivity with the passing of time from exposure to development was small and the storage stability under high-temperature, high-humidity conditions was further improved. Also, more preferable results were obtained by the use of an emulsion added with a thiosulfonate compound represented by Formula (II), (III), or (IV) in the manufacturing process of the reduction-sensitized emulsion.

EXAMPLE 4

Samples 301 to 309 were prepared by replacing the emulsions A1 and B1 in the 6th layer, the emulsion C1 in the 7th layer, and the emulsion D1 in the 8th layer and/or the

TABLE 3

| Sample No. | Amounts of sensitizing dyes used in 12th and 14th layers per mol of silver halide *1 | Emulsion in 12th and 14th layers: Emulsion No. 12th layer/ 14th layer | Reduction sensitizer | Compound represented by Formula (II), (III) or (IV) added *2 | sensitivity | Ratio of increase or decrease in sensitivity after storage at 50° C., 80% RH for 5 days (%) | Ratio of increase or decrease in sensitivity after storage at 25° C., 60% RH for 15 days after exposure (%) |
|---|---|---|---|---|---|---|---|
| 101 (Comparative Example) | 12th layer: ExS-6 ($5.9 \times 10^{-4}$ mol) | G1 and H1/I1 | None | None | 100 | −25 | −20 |
| 201 (Comparative Example) | ExS-9 ($4.7 \times 10^{-4}$ mol) 14th layer: | G2 and H2/I2 | L-ascorbic acid | " | 132 | −28 | −16 |
| 202 (Comparative Example) | ExS-6 ($3.1 \times 10^{-4}$ mol) ExS-9 | G3 and H3/I3 | Thiourea dioxide | " | 130 | −30 | −16 |
| 203 (Comparative Example) | ($2.5 \times 10^{-4}$ mol) | G4 and H4/I4 | L-ascorbic acid | II-21 | 128 | −25 | −24 |
| 204 (Comparative Example) | | G5 and H5/I5 | Thiourea dioxide | II-2 | 130 | −27 | −22 |
| 205 (Comparative Example) | 12th layer: ExS-6 ($5.9 \times 10^{-4}$ mol) | G1 and H1/I1 | None | None | 102 | −13 | −34 |
| 206 (Present Invention) | I-25 ($4.8 \times 10^{-4}$ mol) 14th layer: | G2 and H2/I2 | L-ascorbic acid | " | 138 | −9 | −13 |
| 207 (Present Invention) | ExS-6 ($3.1 \times 10^{-4}$ mol) I-25 | G3 and H3/I3 | Thiourea dioxide | " | 140 | −9 | −13 |
| 208 (Present Invention) | ($2.5 \times 10^{-4}$ mol) | G4 and H4/I4 | L-ascorbic acid | II-21 | 140 | −6 | −8 |
| 209 (Present Invention) | | G5 and H5/I5 | Thiourea dioxide | II-2 | 142 | −6 | −6 |

Note:
*1 I-25 is the exemplified compounds represented by Formula (I) described in the specification.
*2 II-2 and II-21 are the exemplified compounds represented by Formula (II) described in the specification.

This example demonstrates the advantage of the present invention when one of the sensitizing dyes in each blue-sensitive layer spectrally sensitized with a thiasimplecyanine dye was replaced by a 2-quinocyanine dye represented by Formula (I). As is apparent from Table 3, the storage stability under high-temperature, high-humidity conditions was improved only by replacing one of the sensitizing dyes in each of the 12th and 14th layers of the sample 101 with a compound represented by Formula (I). However, this method is unpreferable because the sensitivity largely sensitizing dyes in the 6th, 7th, and 8th layers of the sample 101 of Example 2 as shown in Table 3.

The resultant samples 101 and 301 to 309 were evaluated following the same procedures as in Example 2. The sensitivity is represented by a relative value of the reciprocal of an exposure by which the magenta density of fog+0.4 is given.

The evaluation results are summarized in Table 4 below.

TABLE 4

| Sample No. | Amounts of sensitizing dyes in 6th, 7th and 8th layers per mol of silver halide *1 | Emulsion in 6th, 7th and 8th layers: Emulsion No. 6th layer/ 7th layer/ 8th layer | Reduction sensitizer | Compound represented by Formula (II), (III) or (IV) added *2 | sensitivity | Ratio of increase or decrease in sensitivity after storage at 50° C., 80% RH for 5 days (%) | Ratio of increase or decrease in sensitivity after storage at 25° C., 60% RH for 15 days after exposure (%) |
|---|---|---|---|---|---|---|---|
| 101 (Comparative Example) | 6th layer: ExS-4 ($9.0 \times 10^{-4}$ mol) ExS-5 ($1.8 \times 10^{-4}$ mol) ExS-8 ($5.8 \times 10^{-5}$ mol) 7th layer: ExS-4 ($5.4 \times 10^{-4}$ mol) ExS-5 ($1.1 \times 10^{-4}$ mol) ExS-8 ($3.5 \times 10^{-5}$ mol) 8th layer: ExS-4 ($4.3 \times 10^{-4}$ mol) ExS-5 ($8.6 \times 10^{-5}$ mol) ExS-8 ($2.8 \times 10^{-5}$ mol) | A1 and B1/C1/D1 | None | None | 100 | −19 | −15 |
| 301 (Comparative Example) | | A2 and B2/C2/D2 | L-ascorbic acid | " | 109 | −22 | −13 |
| 302 (Comparative Example) | | A3 and B3/C3/D3 | Thiourea dioxide | " | 111 | −24 | −13 |
| 303 (Comparative Example) | | A4 and B4/C4/D4 | L-ascorbic acid | II-21 | 109 | −26 | −17 |
| 304 (Comparative Example) | | A5 and B5/C5/D5 | Thiourea dioxide | II-2 | 109 | −22 | −15 |
| 305 (Comparative Example) | 6th layer: I-12 ($1.1 \times 10^{-3}$ mol) ExS-5 ($1.8 \times 10^{-4}$ mol) ExS-8 ($5.8 \times 10^{-5}$ mol) 7th layer: I-12 ($6.5 \times 10^{-4}$ mol) ExS-5 ($1.1 \times 10^{-4}$ mol) ExS-8 ($3.5 \times 10^{-5}$ mol) 8th layer: I-12 ($5.2 \times 10^{-4}$ mol) ExS-5 ($8.6 \times 10^{-5}$ mol) ExS-8 ($2.8 \times 10^{-5}$ mol) | A1 and B1/C1/D1 | None | None | 98 | −8 | −28 |
| 306 (Present Invention) | | A2 and B2/C2/D2 | L-ascorbic acid | " | 130 | −5 | −10 |
| 307 (Present Invention) | | A3 and B3/C3/D3 | Thiourea dioxide | " | 132 | −5 | −8 |
| 308 (Present Invention) | | A4 and B4/C4/D4 | L-ascorbic acid | II-21 | 132 | −2 | −3 |
| 309 (Present Invention) | | A5 and B5/C5/D5 | Thiourea dioxide | II-2 | 136 | −2 | −3 |

Note:
*1 I-12 is the exemplified compounds represented by Formula (I) described in the specification.
*2 II-2 and II-21 are the exemplified compounds represented by Formula (II) described in the specification.

This example shows the effect of the present invention when one of oxacarbocyanine dyes used in each green-sensitive layer spectrally sensitized with oxacarbocyanine and oxathiacarbocyanine dyes was replaced with a 2-quinocyanine dye represented by Formula (I). As can be seen from Table 4, it was found that samples in which one of the sensitizing dyes was replaced with a compound represented by Formula (I) and reduction-sensitized emulsions were used were preferable, since the storage stability was high and the photographic properties varied little with the passage of time from exposure to development. Also, as in Examples 2 and 3, more preferable results were obtained by adding a thiosulfonate compound represented by Formula (II), (III), or (IV) in the manufacturing process of an emulsion to be subjected to reduction sensitization.

EXAMPLE 5

In the preparation of emulsions in Example 1, sensitizing dyes were added after grain formation and before chemical sensitization, and then chemical sensitization was performed, in accordance with the examples in JP-A-2-191938. when spectral sensitization was to be performed by using a plurality of sensitizing dyes, these sensitizing dyes were added simultaneously. Following the same procedures as in Examples 2, 3, and 4, the emulsions thus prepared were coated to form multilayered color light-sensitive materials, and evaluations were made. Consequently, results analogous to those in Examples 2, 3, and 4 were obtained. That is, it was found that samples using emulsions spectrally sensitized with a sensitizing dye represented by Formula (I) and also subjected to reduction sensitization in accordance with the aspect of the present invention were preferable, since the storage stability was high and the photographic properties varied little with the passing of time from exposure to development.

By carrying out the present invention, it is possible to improve the storage stability and the sensitivity and to reduce variations in photographic properties with the passage of time from photography to development.

What is claimed is:

1. A silver halide color photographic light-sensitive material which comprises, on a support, at least one blue-sensitive silver halide emulsion layer containing a yellow dye forming coupler, at least one green-sensitive silver halide emulsion layer containing a magenta dye forming coupler, and at least one red-sensitive silver halide emulsion layer containing a cyan dye forming coupler, wherein at least one light-sensitive silver halide emulsion layer is spectrally sensitized with at least one spectral sensitizing dye represented by Formula (I) below, and at least one silver halide emulsion contained in said light-sensitive silver halide emulsion layer is subjected to reduction sensitization in the manufacturing process of said emulsion:

Formula (I)

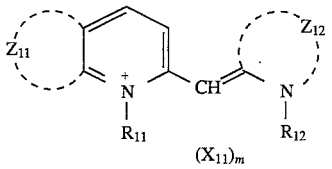

wherein $R_{11}$ and $R_{12}$ may be the same or different and each represent an alkyl group; $Z_{11}$ represents an atomic group required to form a benzene ring together with the carbon atoms; $Z_{12}$ represents an atomic group required to form, together with the nitrogen atom and the carbon atom, a benzoxazole nucleus; $X_{11}$ represents a charge-balancing counter anion; and m represents 0 or 1, with m being 0 when an intramolecular salt is formed.

2. The material according to claim 1, wherein at least one compound represented by Formula (II), (III), or (IV) below is added to said at least one emulsion layer:

Formula (II)

$$R_{21}—SO_2—S—M$$

Formula (III)

$$R_{21}—SO_2—S—R_{22}$$

Formula (IV)

$$R_{21}—SO_2—S—L_m—S—SO_2—R_{23}$$

where $R_{21}$, $R_{22}$, and $R_{23}$ may be the same or different and each represent an aliphatic group, an aromatic group, or a heterocyclic group; M represents a cation; L represents a divalent linking group, and m represents 0 or 1, wherein compounds represented by Formulas (II) to (IV) may each form a polymer containing a divalent group derived from the structure represented by Formula (II), (III) or (IV) as a repeating unit.

3. The silver halide color photographic light-sensitive material according to claim 2, wherein the amount of the compound represented by Formula (II), (III) or (IV) is $10^{-7}$ to $10^{-1}$ mol per mol of silver halide.

4. The material according to claim 1, wherein said at least one emulsion layer is spectrally sensitized with a combination of at least one compound represented by Formula (I) and at least one compound represented by Formula (V) or (VI) below:

Formula (V)

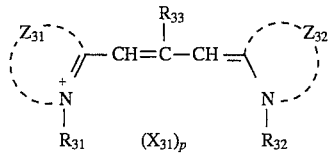

where $R_{31}$ and $R_{32}$ have the same meanings as $R_{11}$ and $R_{12}$ in Formula (I); $R_{33}$ represents a hydrogen atom, an alkyl group, or an aryl group; one of $Z_{31}$ and $Z_{32}$ represents an anomic group required to form a benzoxazole ring together with the carbon atom and the nitrogen atom, and the other represents an atomic group required to form a benzoxazole ring, a benzothiazole ring, a benzoselenazole ring or a benzimidazole ring together with the carbon atom and the nitrogen atom; and $X_{31}$ and p have the same meanings as $X_{11}$ and m, respectively, in Formula (I);

Formula (VI)

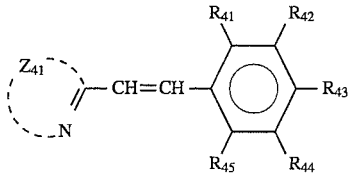

where $Z_{41}$ represents an atomic group required to form a 5- or 6-membered nitrogen containing heterocyclic ring together with the carbon atom and the nitrogen atom; and each of $R_{41}$, $R_{42}$, $R_{43}$, $R_{44}$, and $R_{45}$ represents a substituted amino group, a hydrogen atom, a halogen atom, a hydroxy group, an alkyl group, an alkoxy group, or an aryl group, or every adjacent two of $R_{41}$ to $R_{45}$ may form a 5- or 6-membered ring together with the carbon atoms.

5. The silver halide color photographic light-sensitive material according to claim 4, wherein the 5- or 6-membered nitrogen-containing heterocyclic rings formed from the atomic groups represented by $Z_{31}$ and $Z_{32}$ and the carbon and nitrogen atoms are selected from the group consisting of a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a selenazoline nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthimidazole nucleus, a pyridine nucleus, a quinoline nucleus, an isoquinoline nucleus, an imidazo(4,5-b)quinoxaline nucleus, an oxadiazole nucleus, a thiazole nucleus, a tetrazole nucleus and a pyrimidine nucleus.

6. The silver halide color photographic light-sensitive material according to claim 4, wherein the 5- or 6-membered nitrogen-containing heterocyclic rings formed from the atomic groups represented by $Z_{31}$ and $Z_{32}$ are selected from the group consisting of a benzothiazole nucleus, a benzoxazole nucleus, a naphthoxazole nucleus and a benzoimidazole nucleus.

7. The silver halide color photographic light-sensitive material according to claim 4, wherein $R_{31}$ and $R_{32}$ are selected from the group consisting of sulfoethyl, sulfopropyl, sulfobutyl, carboxymethyl and carboxyethyl.

8. The silver halide color photographic light-sensitive material according to claim 4, wherein the total amount of the compound represented by Formula (V) and (VI) is from 3 to 50 mol % based on the amount of the spectral sensitizing dye represented by Formula (I).

9. The silver halide color photographic light-sensitive material according to claim 1, wherein the reduction sensitization is carried out using stannous chloride, thiourea dioxide, dimethylamineborane and ascorbic acid and its derivatives.

10. The silver halide color photographic light-sensitive material according to claim 9, wherein the amount of reduction sensitizer is from $10^{-7}$ to $10^{-2}$ mol per mol of silver halide.

11. The material according to claim 1, wherein said at least one spectral sensitizing dye represented by Formula (I) is added prior to chemical sensitization in the manufacturing process of said emulsion.

12. The silver halide color photographic light-sensitive material according to claim 1, wherein at least one atom of the atomic group represented by $Z_{11}$ is substituted with an alkyl group, an alkoxy group, an aryloxy group, a halogen atom, an alkylthio group, an acyl group, or an amino group.

13. The silver halide color photographic light-sensitive material according to claim 12, wherein the amino group substituent of $Z_{11}$ is a dimethyl or diethyl amino group.

14. The silver halide color photographic light-sensitive material according to claim 1, wherein the nucleus formed by the atomic group represented by $Z_{12}$ and the nitrogen and carbon atoms is substituted with a halogen atom, an alkyl group, an alkoxy group, an alkylthio group, or an aryl group.

15. The silver halide color photographic light-sensitive material according to claim 1, wherein the alkyl group represented by $R_{11}$ and $R_{12}$ has 18 or less carbon atoms.

16. The silver halide color photographic light-sensitive material according to claim 1, wherein the alkyl group represented by $R_{11}$ and $R_{12}$ is an unsubstituted alkyl group having 1 to 6 carbon atoms, a carboxyalkyl group having 2 to 7 carbon atoms, or a sulfoalkyl group having 1 to 6 carbon atoms.

17. The silver halide color photographic light-sensitive material according to claim 1, wherein the amount of the spectral sensitizing dye represented by Formula (I) is $4\times10^{-6}$ to $2\times10^{-2}$ mol per mol of silver halide.

18. The silver halide color photographic light-sensitive material according to claim 1, wherein the amount of the spectral sensitizing dye represented by Formula (I) is $5\times10^{-5}$ to $5\times10^{-3}$ mol per mol of silver halide.

19. The silver halide color photographic light-sensitive material according to claim 1, wherein the amount of spectral sensitizing dye represented by Formula (I) is at least 40 mol % based on the total amount of spectral sensitizing dyes.

20. The silver halide color photographic light-sensitive material according to claim 4, wherein the amount of spectral sensitizing dye represented by Formula (I) is at least 70 mol % based on the total amount of spectral sensitizing dyes.

* * * * *